US006948282B2

(12) United States Patent
Bott

(10) Patent No.: US 6,948,282 B2
(45) Date of Patent: Sep. 27, 2005

(54) INTERLOCKING BUILDING BLOCK

(75) Inventor: Timothy A. Bott, Sunfish Lake, MN (US)

(73) Assignee: Allan Block Corporation, Edina, MN (US)

( * ) Notice: Subject to any disclaimer, the term of this patent is extended or adjusted under 35 U.S.C. 154(b) by 0 days.

(21) Appl. No.: 10/418,563

(22) Filed: Apr. 17, 2003

(65) Prior Publication Data

US 2004/0134154 A1 Jul. 15, 2004

Related U.S. Application Data

(60) Provisional application No. 60/438,960, filed on Jan. 9, 2003.

(51) Int. Cl.[7] ..... E04C 2/04; E02D 29/02

(52) U.S. Cl. ..... 52/98; 52/604; 52/605; 52/606; 52/608; 52/592.6; 402/284

(58) Field of Search ..... 52/98, 100, 604, 52/605, 606, 608, 609, 592.6, 574; 405/284, 286

(56) References Cited

U.S. PATENT DOCUMENTS

| | | | | |
|---|---|---|---|---|
| 474,285 | A | | 5/1892 | Borgner |
| 689,523 | A | | 12/1901 | Trumball |
| 811,534 | A | | 2/1906 | Akers et al. |
| 829,397 | A | | 8/1906 | Gerber |
| 829,711 | A | | 8/1906 | Gaylor et al. |
| 916,687 | A | | 3/1909 | Everett et al. |
| 951,624 | A | | 3/1910 | Davidson |
| 979,913 | A | | 12/1910 | Ault |
| 1,009,469 | A | | 11/1911 | Burrowes |
| 1,369,115 | A | | 2/1921 | Kline |
| 1,388,181 | A | | 8/1921 | Guimonneau |
| 1,418,168 | A | | 5/1922 | Preston |
| 1,444,554 | A | | 2/1923 | Quillet |
| 1,468,892 | A | | 9/1923 | Ver Mehr |
| 1,516,473 | A | * | 11/1924 | Davis ..... 52/592.1 |
| 1,630,698 | A | | 5/1927 | Florey |
| 1,657,861 | A | * | 1/1928 | Lucas ..... 52/592.6 |
| 1,681,631 | A | | 8/1928 | Tambone |
| 1,689,107 | A | | 10/1928 | Bradley |
| 1,761,614 | A | | 6/1930 | Collier |
| 1,898,297 | A | | 2/1933 | Fox |
| 2,019,653 | A | | 11/1935 | Buyer ..... 72/41 |
| 2,140,773 | A | | 12/1938 | Slayter et al. |
| 2,141,397 | A | | 12/1938 | Locke |
| 2,157,992 | A | | 5/1939 | Smith |
| 2,201,110 | A | | 5/1940 | Makram |

(Continued)

FOREIGN PATENT DOCUMENTS

| | | |
|---|---|---|
| AU | 737866 | 3/1999 |
| BE | 407 854 A | 2/1935 |

(Continued)

*Primary Examiner*—Robert Canfield
(74) *Attorney, Agent, or Firm*—Fredrikson & Byron, P.A.

(57) ABSTRACT

The present building block has at least one inner core, a secondary or end core portion, and an interlock protruding from one face and forming a portion of the periphery of at least one of the inner cores. When placed end to end and at the same level, building blocks of the present invention form a secondary core or seat for reception of the interlock. When a first row of building blocks placed end to end is staggered relative to a second row of building blocks placed end to end, the interlocks of one row of building blocks mate with the secondary or end core portions or relatively large inner cores of the other row of building blocks such that neighboring rows of building block interlock. The basic building block has ends that are oblique such that rows having a preset radius can be formed or such that a linear row can be formed by placing one block front-to-back and an adjacent building block back-to-front. Disclosed are angle blocks with and without splitter wedges, stretcher blocks with and without splitter wedges, blocks for forming corners and posts, cap blocks, and blocks for capping posts.

66 Claims, 19 Drawing Sheets

U.S. PATENT DOCUMENTS

| | | | | | |
|---|---|---|---|---|---|
| 2,205,419 | A | * | 6/1940 | Kraemer | 52/592.3 |
| 2,241,169 | A | | 5/1941 | Yokes | 72/42 |
| 2,321,403 | A | | 6/1943 | McCabe | 72/38 |
| 2,498,276 | A | | 2/1950 | Kany | |
| 2,610,503 | A | | 9/1952 | Hall | |
| 2,624,193 | A | | 1/1953 | Larson | |
| 2,668,435 | A | * | 2/1954 | Clements | 52/592.3 |
| 2,703,487 | A | * | 3/1955 | Ossoinack | 52/592.3 |
| 2,826,906 | A | * | 3/1958 | Rice | 52/585.1 |
| 2,911,818 | A | | 11/1959 | Smith | |
| D198,527 | S | | 6/1964 | Long | |
| 3,305,982 | A | | 2/1967 | Steele | 52/90 |
| 3,534,518 | A | | 10/1970 | Zagray | |
| 3,618,279 | A | * | 11/1971 | Sease | 52/223.7 |
| 3,881,571 | A | | 5/1975 | Moulton | 182/178 |
| 3,888,060 | A | * | 6/1975 | Haener | 52/284 |
| D243,855 | S | | 3/1977 | Hynes | |
| 4,031,678 | A | | 6/1977 | Schuring | 52/285 |
| 4,078,760 | A | | 3/1978 | Mullins | 249/120 |
| 4,107,894 | A | | 8/1978 | Mullins | 52/593 |
| 4,148,166 | A | | 4/1979 | Toone | |
| 4,186,540 | A | | 2/1980 | Mullins | 52/593 |
| 4,262,463 | A | * | 4/1981 | Hapel | 52/98 |
| D261,047 | S | | 9/1981 | Long | |
| 4,297,816 | A | * | 11/1981 | Kella et al. | 52/125.3 |
| 4,301,637 | A | * | 11/1981 | Anderson | 52/592.6 |
| 4,372,091 | A | * | 2/1983 | Brown et al. | 52/592.6 |
| 4,436,447 | A | | 3/1984 | Crowe | 405/16 |
| 4,475,326 | A | | 10/1984 | Hanson | 52/286 |
| 4,565,043 | A | | 1/1986 | Mazzarese | 52/593 |
| 4,640,071 | A | * | 2/1987 | Haener | 52/286 |
| 4,854,103 | A | * | 8/1989 | Klym | 52/592.6 |
| 4,887,403 | A | | 12/1989 | Bonner | 52/286 |
| 4,896,472 | A | | 1/1990 | Hunt | 52/593 |
| 4,922,678 | A | | 5/1990 | Scheiwiller | |
| 4,965,979 | A | * | 10/1990 | Larrivee et al. | 52/592.6 |
| 5,024,035 | A | | 6/1991 | Hanson et al. | 52/591 |
| 5,119,587 | A | | 6/1992 | Waltz | |
| 5,154,032 | A | | 10/1992 | Ritter | |
| 5,181,362 | A | | 1/1993 | Benitez | |
| D336,686 | S | | 6/1993 | Pederson | |
| D340,997 | S | | 11/1993 | Harrison | |
| D342,580 | S | | 12/1993 | Harrison | |
| 5,337,527 | A | | 8/1994 | Wagenaar | 52/169.2 |
| 5,350,256 | A | | 9/1994 | Hammer | |
| 5,402,609 | A | | 4/1995 | Kelley, Jr. | 52/98 |
| 5,421,135 | A | | 6/1995 | Stevens et al. | |
| 5,457,926 | A | * | 10/1995 | Jensen | 52/604 |
| 5,535,568 | A | | 7/1996 | Quinn | |
| 5,536,111 | A | | 7/1996 | Doernemann | |
| 5,548,938 | A | | 8/1996 | Scheiwiller | |
| 5,551,198 | A | | 9/1996 | Schaaf et al. | |
| 5,623,797 | A | | 4/1997 | Gravier et al. | |
| 5,651,642 | A | | 7/1997 | Kelley, Jr. et al. | 405/286 |
| 5,653,558 | A | | 8/1997 | Price | |
| 5,685,119 | A | | 11/1997 | Zschoppe | 52/592.5 |
| 5,688,078 | A | | 11/1997 | Hammer | |
| D387,431 | S | | 12/1997 | Tremblay | |
| 5,704,183 | A | | 1/1998 | Woolford | |
| 5,707,184 | A | | 1/1998 | Anderson et al. | |
| 5,709,062 | A | | 1/1998 | Woolford | |
| 5,729,943 | A | | 3/1998 | Cambiuzzi | |
| D397,230 | S | | 8/1998 | Forsberg | |
| 5,788,423 | A | | 8/1998 | Perkins | |
| D403,438 | S | | 12/1998 | Risi et al. | |
| 5,894,702 | A | * | 4/1999 | Stenekes | 52/606 |
| 5,984,589 | A | | 11/1999 | Ciccarello | |
| D417,506 | S | | 12/1999 | Harding | |
| 6,035,599 | A | | 3/2000 | Sonnentag | |
| 6,062,772 | A | | 5/2000 | Perkins | |
| 6,082,067 | A | | 7/2000 | Bott | |
| 6,088,987 | A | | 7/2000 | Simmons et al. | |
| 6,149,352 | A | | 11/2000 | MacDonald | |
| 6,168,353 | B1 | | 1/2001 | Price | |
| 6,233,897 | B1 | | 5/2001 | Jurik | |
| RE37,278 | E | | 7/2001 | Forsberg | |
| 6,253,519 | B1 | * | 7/2001 | Daniel | 52/591.1 |
| 6,312,197 | B1 | | 11/2001 | Woolford et al. | |
| 6,322,742 | B1 | | 11/2001 | Bott | |
| 6,447,213 | B1 | * | 9/2002 | MacDonald | 405/284 |
| 6,490,837 | B1 | | 12/2002 | Dueck et al. | |
| 2001/0004822 | A1 | | 6/2001 | Martin et al. | |
| 2001/0023559 | A1 | * | 9/2001 | Ozawa et al. | 52/100 |
| 2002/0028114 | A1 | | 3/2002 | Whitson | |
| 2002/0148187 | A1 | | 10/2002 | Walters | |
| 2002/0187010 | A1 | | 12/2002 | MacDonald et al. | |

FOREIGN PATENT DOCUMENTS

| | | | |
|---|---|---|---|
| BE | 501 899 | A | 6/1952 |
| BE | 1 008 966 | A | 10/1996 |
| CA | 14561 | | 2/1882 |
| CA | 50243 | | 2/1895 |
| CA | 58421 | | 7/1897 |
| CA | 193538 | | 1/1903 |
| CA | 124543 | | 12/1909 |
| CA | 455960 | | 4/1949 |
| CA | 477777 | | 10/1951 |
| CA | D-18611 | | 4/1952 |
| CA | 511636 | | 4/1955 |
| CA | 798042 | | 11/1968 |
| CA | D-39809 | | 10/1975 |
| CA | 981480 | | 1/1976 |
| CA | 1070971 | | 2/1980 |
| CA | D-50779 | | 1/1983 |
| CA | D-52836 | | 5/1984 |
| CA | 1197391 | | 12/1985 |
| CA | 1203395 | | 4/1986 |
| CA | 2119458 | | 4/1993 |
| CA | 1324266 | | 11/1993 |
| CA | 2075580 | | 2/1994 |
| CA | 2149762 | | 5/1994 |
| CA | D-77829 | | 1/1996 |
| CA | D-78184 | | 4/1996 |
| CA | 2165253 | | 6/1996 |
| CA | 2173649 | | 10/1997 |
| CA | D-84184 | | 6/1998 |
| CA | 2231567 | | 9/1998 |
| CA | D-87009 | | 6/1999 |
| CA | 2318617 | | 7/1999 |
| CA | 2145344 | | 1/2001 |
| CA | D-92983 | | 7/2001 |
| CA | D-92984 | | 7/2001 |
| CA | D-93841 | | 11/2001 |
| CA | D-93842 | | 11/2001 |
| CA | 2355010 | | 2/2002 |
| CA | 2356173 | | 2/2002 |
| CH | 85182 | | 10/1920 |
| DE | 88 022 | C | 8/1896 |
| DE | 864 998 | C | 1/1953 |
| DE | 3 501 908 | | 1/1985 |
| EP | 0 498 140 | A | 8/1992 |
| EP | 0507970 | | 10/1992 |
| EP | 0728878 | | 8/1996 |
| EP | 1054114 | | 11/2000 |
| FR | 21 481 | E | 10/1920 |
| FR | 2 533 956 | | 4/1984 |
| GB | 21559 | | 4/1901 |
| GB | 166623 | | 7/1921 |
| GB | 540745 | | 10/1941 |
| GB | 561654 | | 5/1944 |
| GB | 619 456 | A | 3/1949 |
| JP | WO 02/20913 | A | 3/2002 |
| WO | WO 82/02732 | | 2/1982 |
| WO | WO 00/22243 | | 4/2000 |

* cited by examiner

INTERLOCKING BUILDING BLOCK

This application claims the benefit under 35 U.S.C. §119(e) of U.S. Provisional Patent Application No. 60/438,960 filed Jan. 9, 2003.

BACKGROUND OF THE INVENTION

The present invention relates generally to a building block for building a free-standing mortarless wall, particularly to such a building block having an interlock and flat surfaces extending outwardly from the interlock, and specifically to such an interlocking building block having at least one core and further having a secondary or end core portion formed on each end of the building block for being seated upon an interlock of an adjoining lower building block.

Dragsters have rear wheel mounted slicks, which are wide flat tires with little or no tread. The relatively great amount of surface area better grabs the road for acceleration. Treads decrease the amount of grab and therefore decrease the amount of acceleration.

WWII style jeeps run on relatively skinny tires. The skinnier the tire, the more pressure per square inch on the portion of the tire digging down into the mud or sand, and the better the traction.

The lessons of flatness and pressure, well-known in the automobile arts, have been overlooked by building block manufacturers. A great number of building blocks have recesses or grooves for performing a various number of functions. Likewise, a great number of building blocks have extensions or projections or nubs for performing a various number of functions. Often, if not a majority of the time, these recesses or extensions of the building block necessarily transfer the load bearing function to other portions of the building block. Such a transfer may place an undue amount of stress in such other portions of the building block or may imbalance the block or a wall formed by such blocks.

With appreciation for the lessons of flatness and pressure, a mortarless and free-standing wall according to the present invention may be built having a great amount of stability with or without internal piping.

SUMMARY OF THE INVENTION

A feature of the present invention is the provision in a building block having at least one core and a pair of secondary or end core portions that form secondary cores with adjacent building blocks, of an interlock protruding from a load bearing face of the building block and forming at least a portion of the periphery of the core for reception in a secondary core portion of an adjacent building block placed at an adjoining level.

Another feature of the present invention is the provision in a building block having at least one core and a pair of secondary or end core portions that form secondary cores with adjacent building blocks, of an interlock protruding from a load bearing face of the building block and forming at least a portion of the periphery of the core for reception in a secondary core portion of an adjacent building block placed at an adjoining level, and of the interlock being arcuate and endless and running about a perimeter of the core.

Another feature of the present invention is the provision in a building block having at least one core and a pair of secondary or end core portions that form secondary cores with adjacent building blocks, of an interlock protruding from a load bearing face of the building block and forming at least a portion of the periphery of the core for reception in a secondary core portion of an adjacent building block placed at an adjoining level, of first and second load bearing faces of the building block being substantially flat without taking into account the interlock, and of the first and second load bearing faces being parallel.

Another feature of the present invention is the provision in a building block having at least one core and a pair of secondary or end core portions that form secondary cores with adjacent building blocks, of an interlock protruding from a load bearing face of the building block and forming at least a portion of the periphery of the core for reception in a secondary core portion of an adjacent building block placed at an adjoining level, and of the interlock having a splitter wedge such that first and second spaced apart interlocking segments are formed.

Another feature of the present invention is the provision in a building block having at least one core and a pair of secondary or end core portions that form secondary cores with adjacent building blocks, of an interlock protruding from a load bearing face of the building block and forming at least a portion of the periphery of the core for reception in a secondary core portion of an adjacent building block placed at an adjoining level, and of two opposite sides of the building block being textured such that the two opposite sides are aesthetic.

Another feature of the present invention is the provision in a building block having a set of three cores and a pair of secondary or end core portions that form secondary cores with adjacent building blocks, of interlocks protruding from a load bearing face of the building block and forming at least a portion of the periphery of a respective two of the cores for reception in respective secondary core portions of adjacent building blocks placed at an adjoining level.

Another feature of the present invention is the provision in a building block having a set of three cores and a pair of secondary or end core portions that form secondary cores with adjacent building blocks, of interlocks protruding from a load bearing face of the building block and forming at least a portion of the periphery of a respective two of the cores for reception in respective secondary core portions of adjacent building blocks placed at an adjoining level, and of a splitter wedge forming a portion of one core to provide an aid for splitting the block in the field.

Another feature of the present invention is the provision in a building block having a set of three cores and a pair of secondary or end core portions that form secondary cores with adjacent building blocks, of interlocks protruding from a load bearing face of the building block and forming at least a portion of the periphery of a respective two of the cores for reception in respective secondary core portions of adjacent building blocks placed at an adjoining level, and of a splitter wedge cutting across an interlock to provide an aid for splitting the block in the field.

Another feature of the present invention is the provision in a building block having a set of three cores and a pair of secondary or end core portions that form secondary cores with adjacent building blocks, of interlocks protruding from a load bearing face of the building block and forming at least a portion of the periphery of a respective two of the cores for reception in respective secondary core portions of adjacent building blocks placed at an adjoining level, and of the two cores being of different size, one sufficiently small so as to exclude the seating of an interlock of a potentially adjoining building block, and one sufficiently large to as to seat an interlock of an adjoining building block.

Another feature of the present invention is the provision in a building block having a set of two cores and a secondary or end core portion in one end of the building block, of the two cores being of different size, one sufficiently small so as to exclude the seating of an interlock of a potentially adjoining building block, and one sufficiently large to as to seat an interlock of an adjoining building block.

An advantage of the present invention is stability. The present building blocks can form a free standing mortarless wall having great stability without piping. One feature contributing to this advantage is the interlock. Another feature contributing to this advantage is the flatness of the upper and lower load bearing faces that provides load to be transmitted evenly over a maximum amount of surface area.

Another advantage of the present invention is that piping may be incorporated into the free standing mortarless wall. As such a wall is built, cores are naturally aligned to permit the placement of pipes therein.

Another advantage of the present invention is that the present interlocks may be seated in some cores and not in other cores. Such a natural selection and exclusion provides for a mistake free and self-aligning wall.

Another advantage is that the building block may be used as the basis for a unique wall. For example, the interlock and its mating secondary or end core portion are structured to permit building blocks, of one shape, to form either a straight wall or a curved wall. Also, ends of the building block are oblique such that a set of basic building blocks having one shape can form a straight wall or a curved or undulating wall. Further, the interlock and its mating secondary core portion may be rotationally adjusted and still interlock, such as when the homeowner saws off or splits off the end of the building block to make her own unique angle or curvature. Moreover, the secondary core portion is formed relatively deeply in the building block such that a recess still remains in the building block for the interlock when a home owner saws off such end of the building block.

Another advantage is that a free standing wall built by a set of the present building blocks is safe with or without glue, is safe with or without posts, is safe while being built, is safe after completion, and is safe for a great number of years. For instance, the present building block has inner cores and secondary (or end) core portions so as to be hollow and relatively light and easy to handle for the do-it-yourself home owner. Further, the interlocks minimize movement of just laid down building blocks so as to minimize toppling of walls under construction. Still further, some interlocks are have splitter wedges to permit field modification. Also, posts may be inserted through any of the cores or need not be inserted at all.

Another advantage is the ability to build in structural stability achieved when serpentine or curved walls are constructed.

Another advantage is the ability to build in structural stability achieved when zig zag type walls are constructed.

Another advantage is the ability to achieve rigidity with or without piping. When used, a lower portion of piping is driven into the ground and an upper portion of the piping confronts internal cores, namely the cores of interlocks.

Another advantage is that the free standing wall can be relatively easily removed by a subsequent home owner. The free standing wall built by a set of the present building blocks does not require reinforcing rods, posts, glue, or relatively deep holes dug into the ground. Further, the present building block is relatively hollow to thereby minimize mass that must be removed by a home owner having different tastes.

Another advantage is that the present building block is relatively inexpensive to manufacture.

Other and further features and advantages of the present invention will become apparent to those skilled in the art upon a review of the accompanying specification and drawings.

IN THE DRAWINGS

DESCRIPTION OF THE PREFERRED EMBODIMENT

Figure 1:
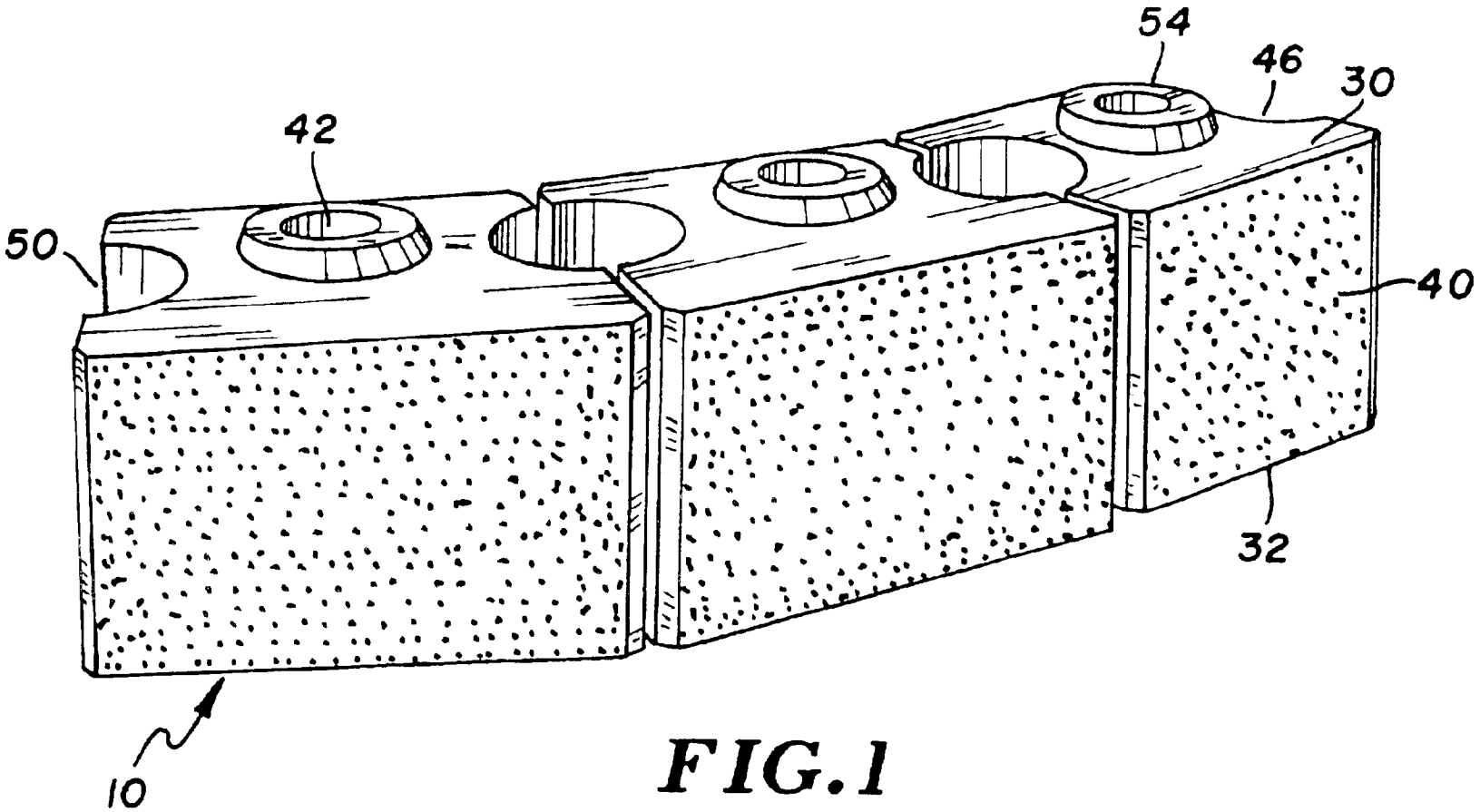
FIG. 1 is a perspective view of the angle block of the present invention having the endless interlock.
Figure 2A:
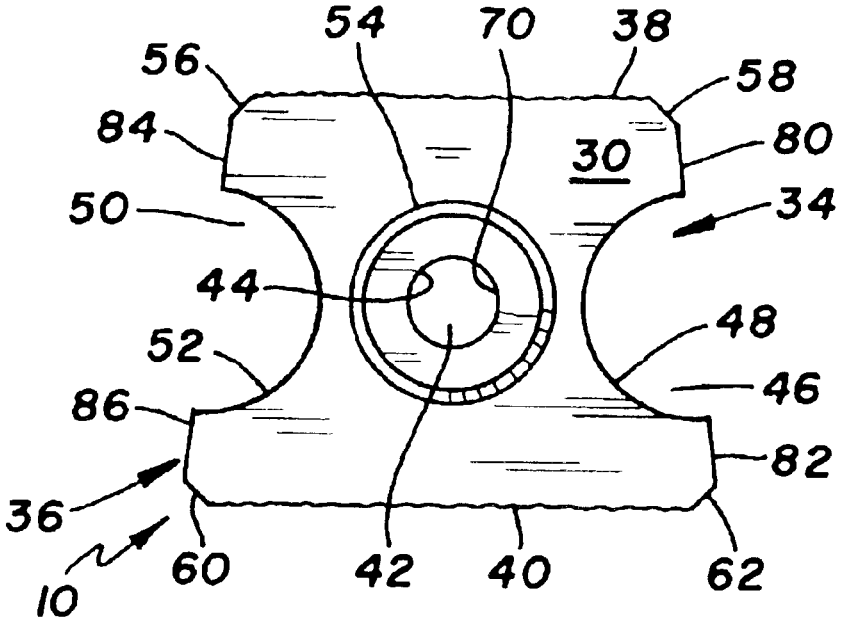
FIG. 2A is a top view of the angle block of FIG. 1.
Figure 2B:
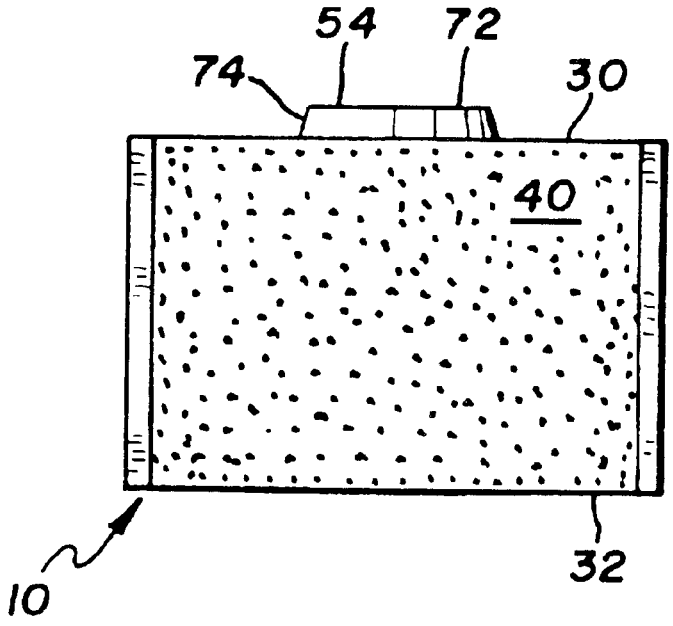
FIG. 2B is a side view of the angle block of FIG. 2A.
Figure 3A:
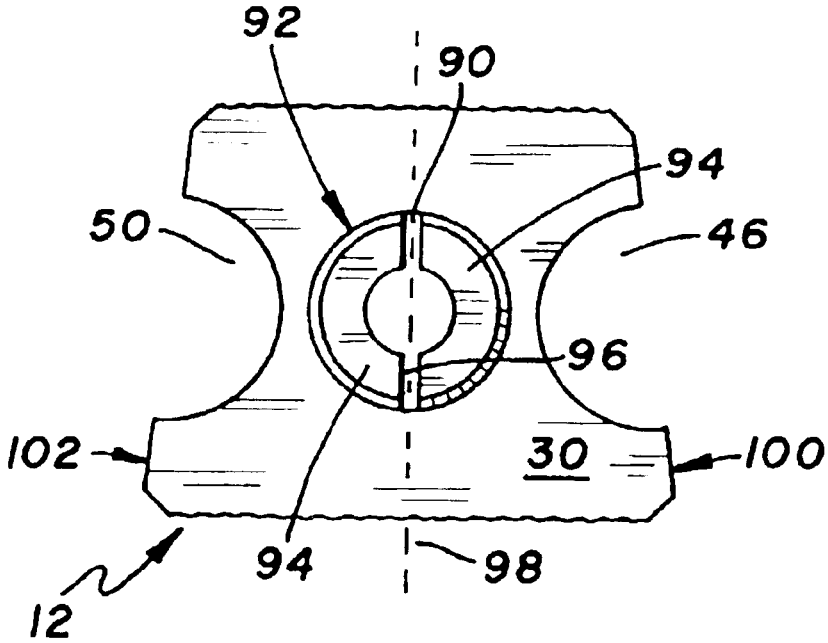
FIG. 3A is a top view of the angle block of the present invention having a splitter wedge at the interlock.
Figure 3B:
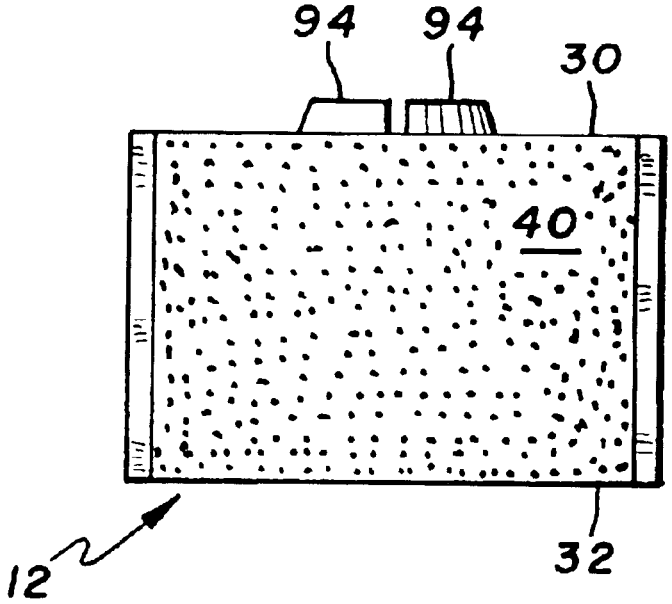
FIG. 3B is a side view of the angle block of FIG. 3A.
Figure 5A:
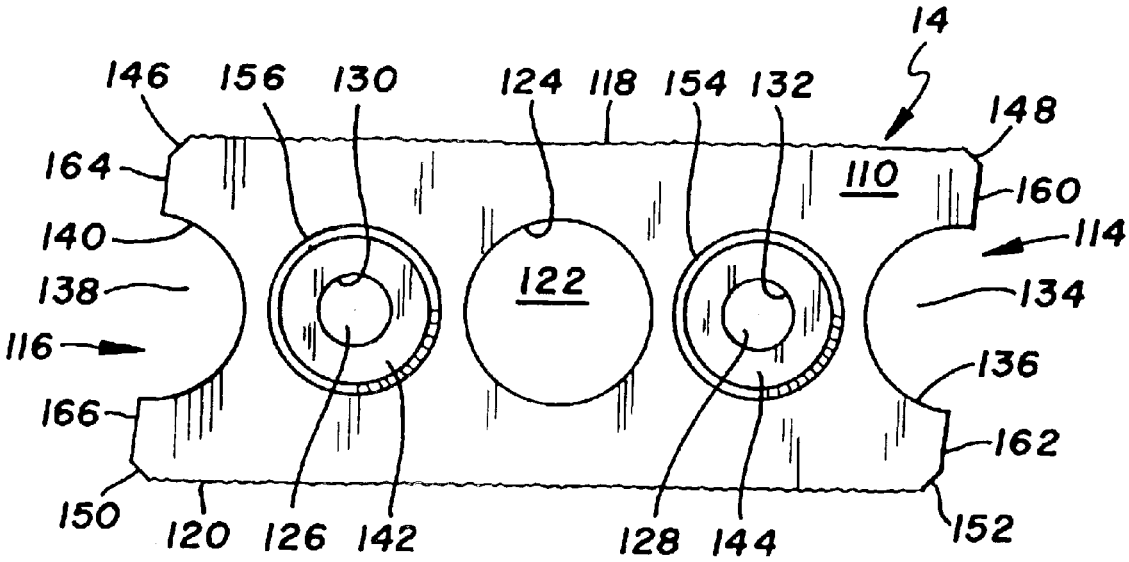
FIG. 5A is a top view of the stretcher block of the present invention having a pair of endless interlocks.
Figure 5B:
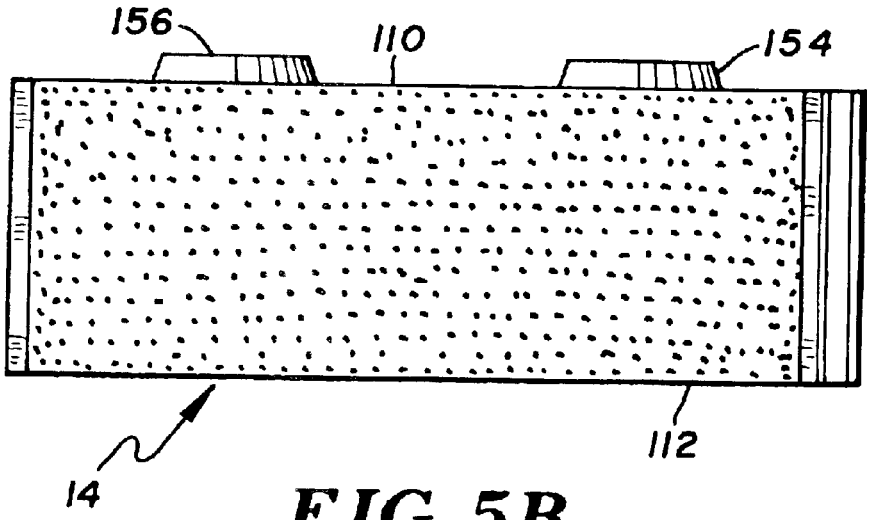
FIG. 5B is a side view of the stretcher block of FIG. 5A.
Figure 6A:
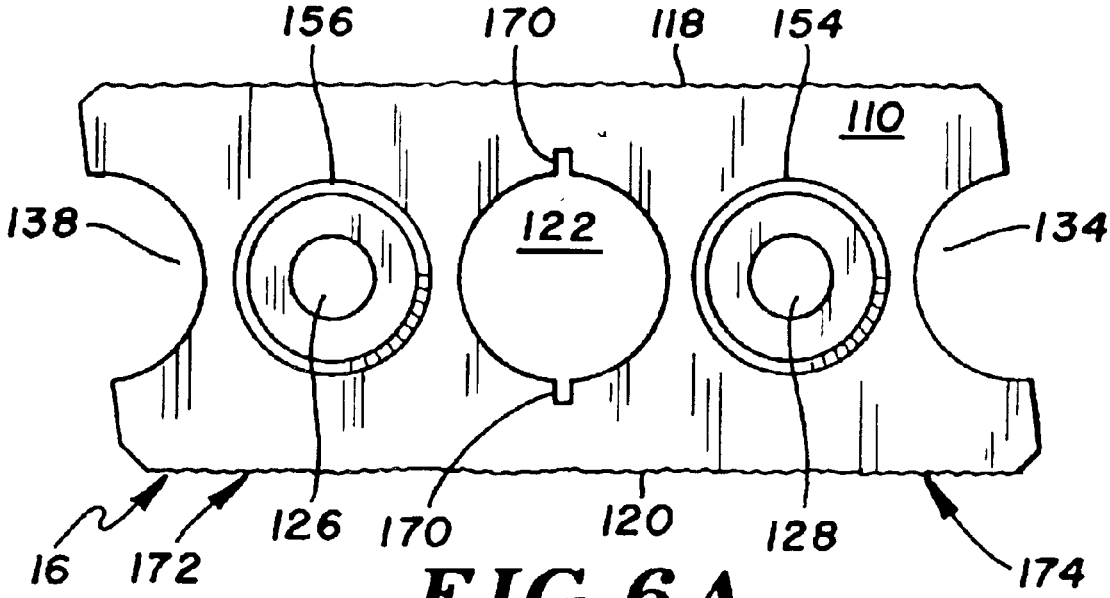
FIG. 6A is a top view of the stretcher block of the present invention having a splitter wedge at the central core.
Figure 6B:
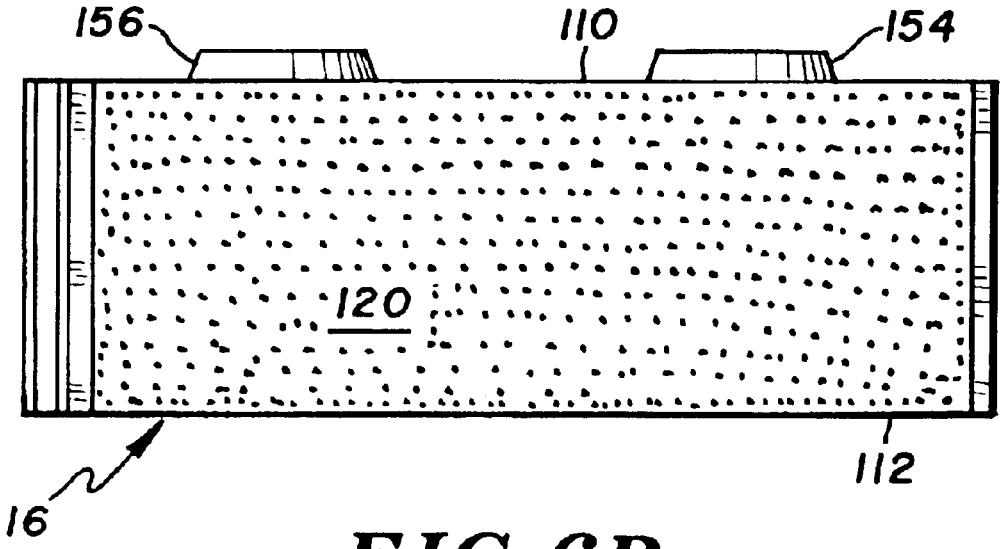
FIG. 6B is a side view of the stretcher block of FIG. 6A.
Figure 7A:
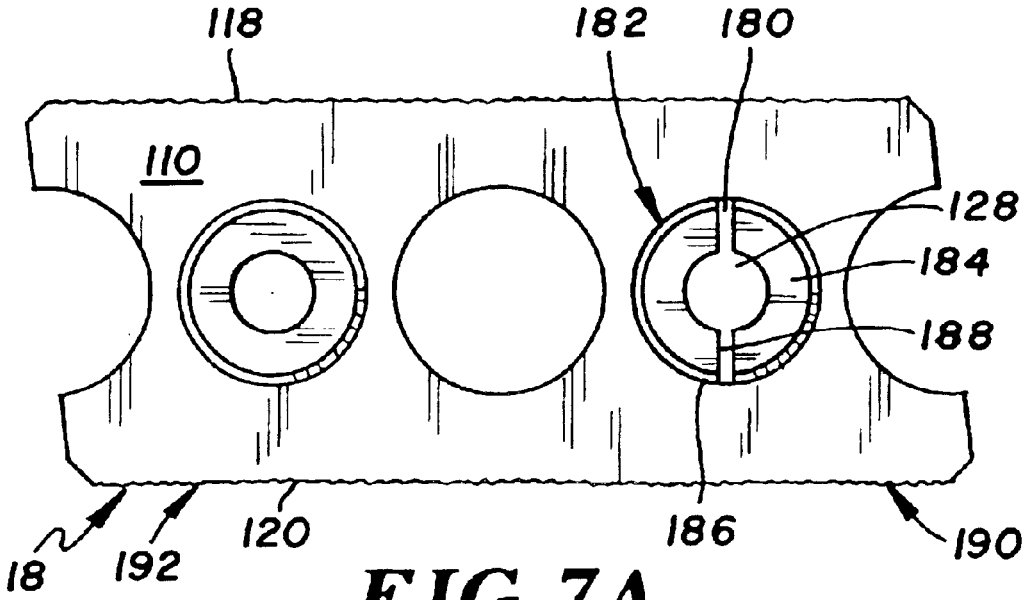
FIG. 7A is a top view of the stretcher block of the present invention having a splitter wedge at one of the interlocks.
Figure 7B:
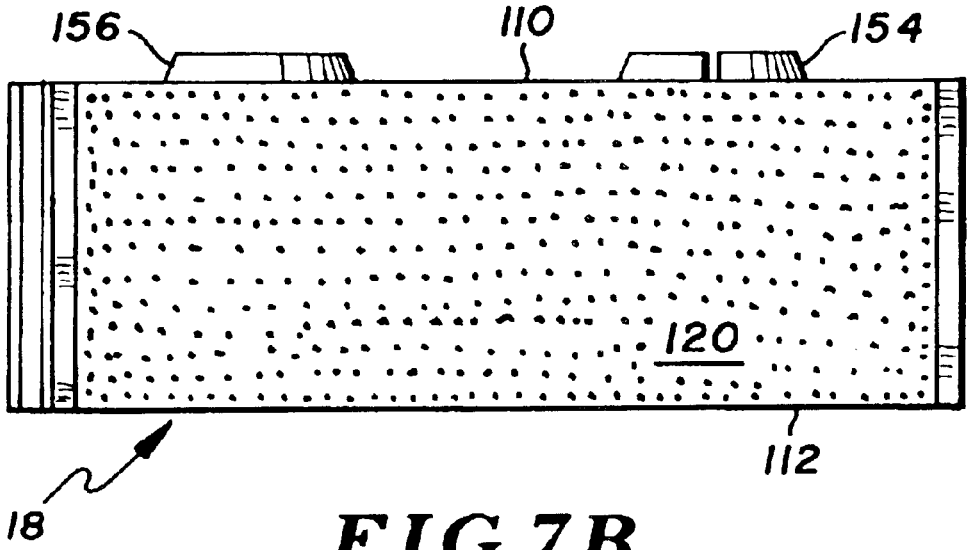
FIG. 7B is a side view of the stretcher block of FIG. 7A.
Figure 9A:
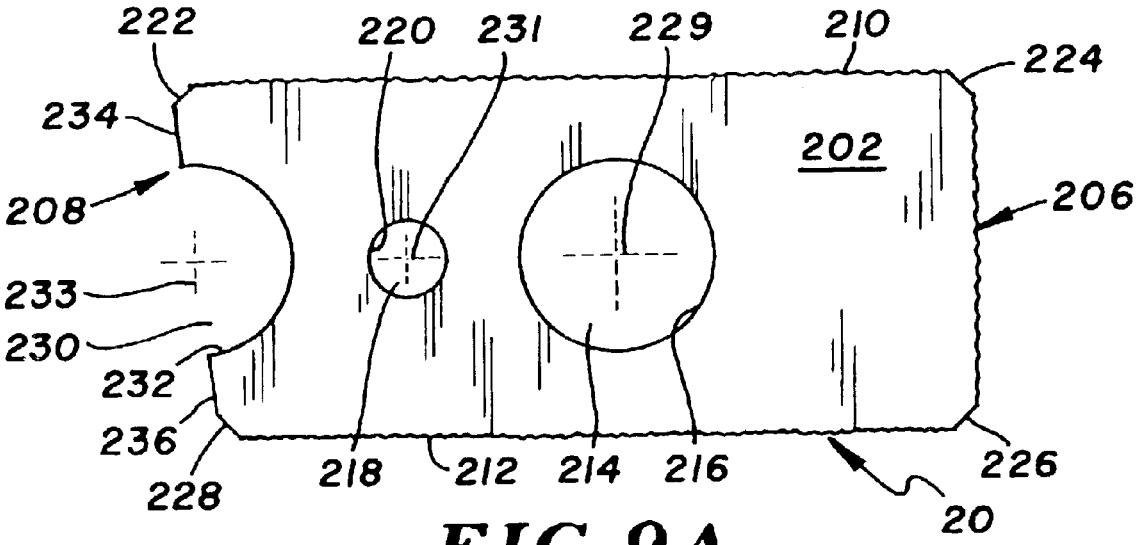
FIG. 9A is a top view of a corner block of the present invention.
Figure 9B:
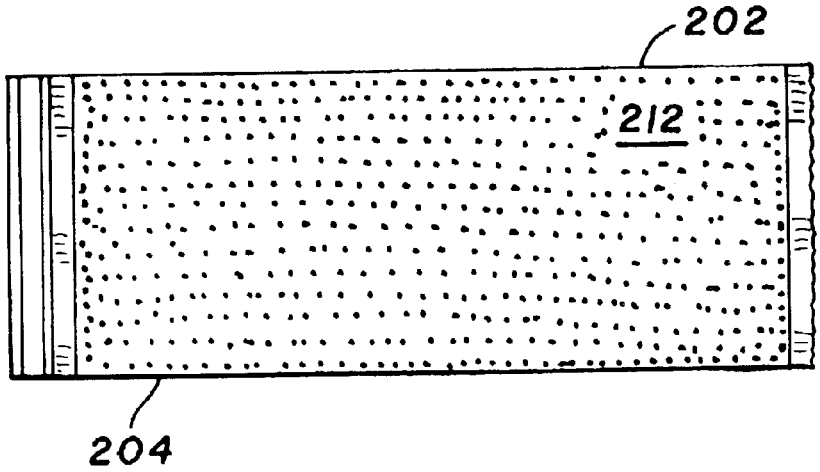
FIG. 9B is a side view of the corner block of FIG. 9A.
Figure 11A:
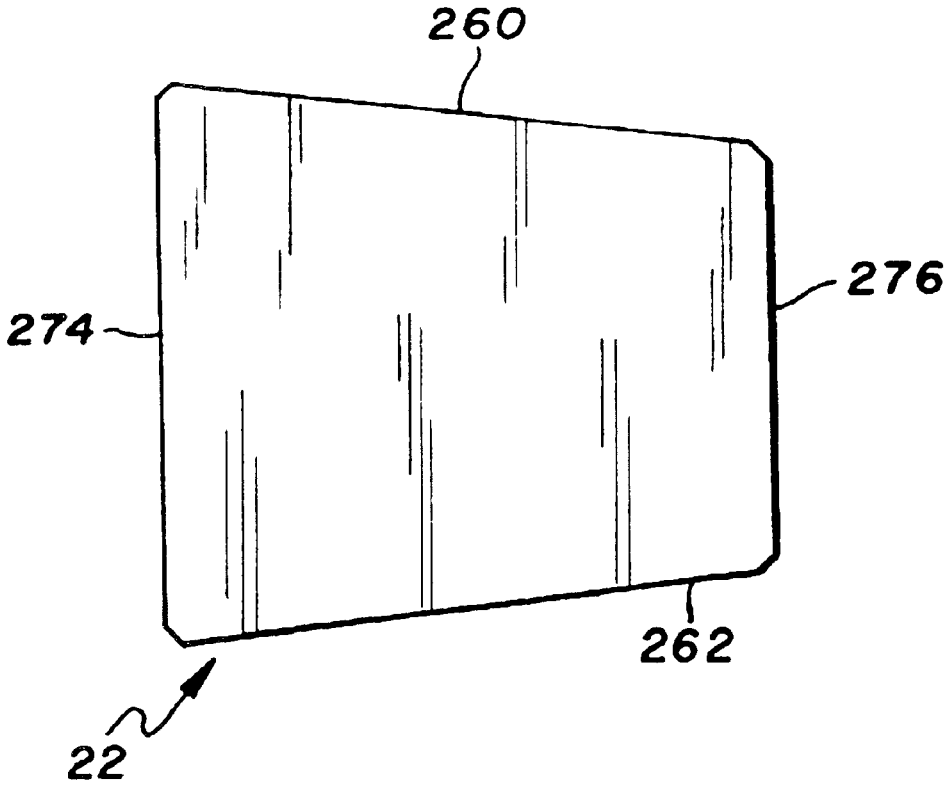
FIG. 11A is a top view of the cap block of the present invention.
Figure 11B:
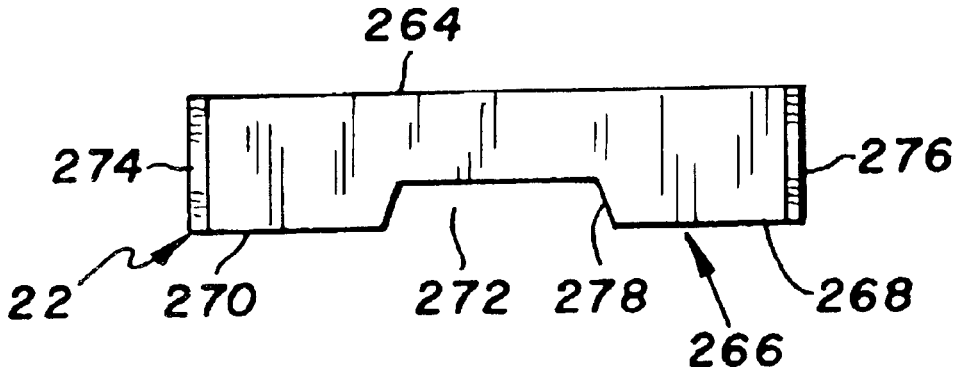
FIG. 11B is a side view of the cap block of FIG. 11A.
Figure 13A:
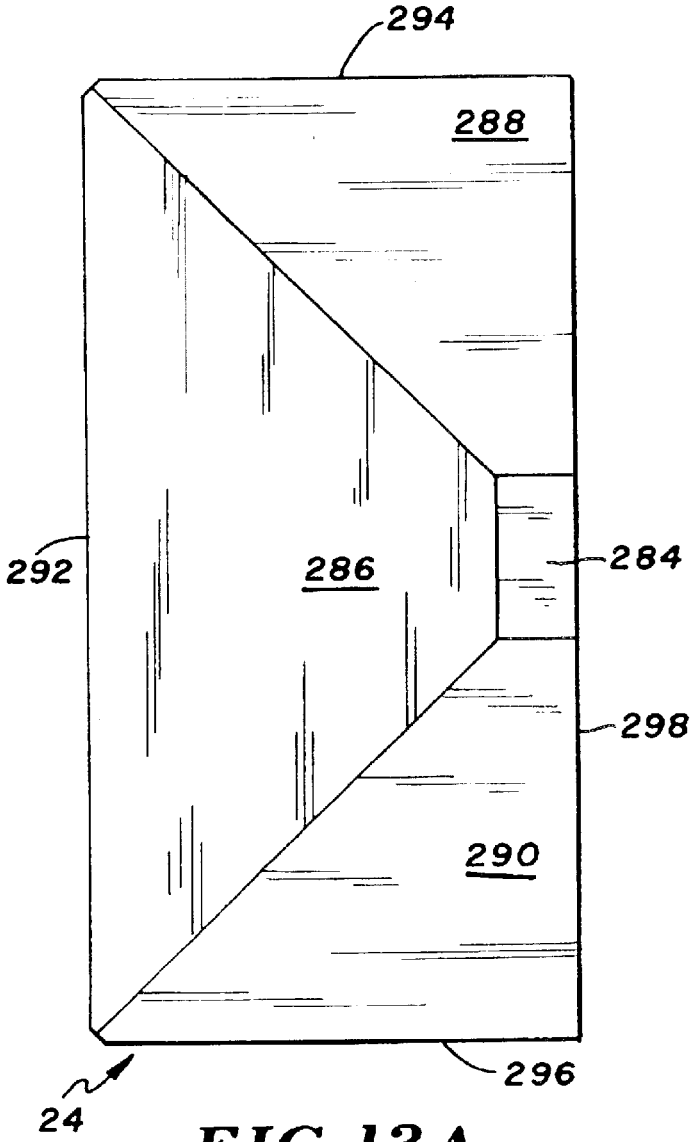
FIG. 13A is a top view of a post cap block of the present invention.
Figure 13B:
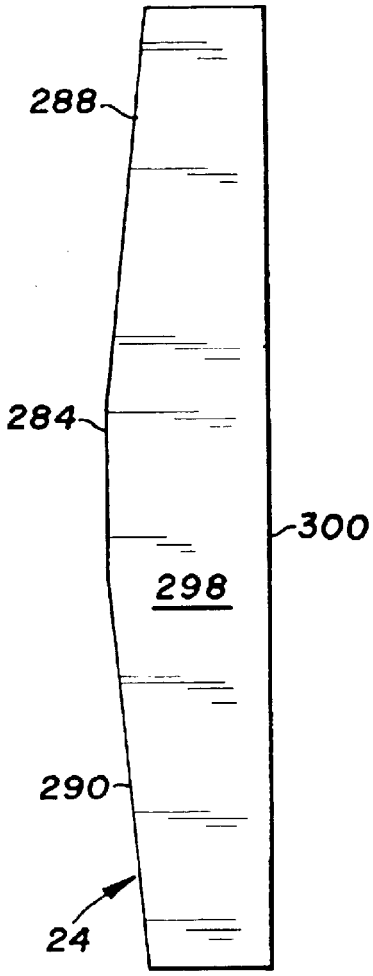
FIG. 13B is an end view of the post cap block of FIG. 13A.

In accordance with a preferred embodiment of the present invention, a set of building blocks for one or more portions of a mortarless free standing wall having two textured opposing sides includes an angle block 10 shown in FIGS. 1, 2A and 2B, an angle block 12 having a splitter wedge and shown in FIGS. 3A and 3B, a stretcher block or double unit block 14 shown in FIGS. 5A and 5B, a stretcher block or double unit block 16 having a splitter wedge at the central core and shown in FIGS. 6A and 6B, a stretcher block or double unit block 18 having a splitter wedge at one interlock and shown in FIGS. 7A and 7B, a corner block 20 shown in FIGS. 9A and 9B, a cap block 22 shown in FIGS. 11A and 11B, and a post cap block 24 shown in FIGS. 13A and 13B.

Angle Block 10

As shown in FIGS. 1, 2A and 2B, angle block 10 generally includes a first load bearing face 30, a second load bearing face 32, a first end 34, a second end 36, a first side 38, and a second side 40. Angle block 10 further includes a first or central or inner or primary core 42 defined by a cylindrical or core wall 44, a secondary or end core portion or end arcuate recess or seat 46 defined by a cylindrical or core wall 48, a secondary or end core portion or end arcuate recess or seat 50 defined by a cylindrical or core wall 52, and an endless interlock 54 about a perimeter of the primary core 42. Angle block 10 still further includes four corner faces or chamfers 56, 58, 60, and 62.

As shown in FIGS. 2A and 2B, first loading bearing face 30 is disposed opposite of second load bearing face 32. Each of the load bearing faces 30, 32 is disposed in a plane that is parallel to the plane of the other load bearing face. Each of the load bearing faces 30, 32 is transverse to or lies at a crosswise direction relative to ends 34, 36 and sides 38, 40. Generally, each of the load bearing faces 30, 32 is trapezoidal. Specifically, each of the load bearing faces 30, 32 is bounded by a set of 12 edges formed by the corner faces or chamfers 56, 58, 60 and 62, the ends 34, 36 having the secondary walls 48, 52, and the sides 38, 40.

Primary core 42 is formed centrally in angle block 10 and extends to and between each of the load bearing faces 30, 32. An axis running centrally through primary core 42 is equidistant from side 38 and side 40 and is further equidistant from a midpoint on end 34 and a midpoint on end 36.

Primary core 42 is an internal core. That is, primary core 42 is spaced from each of the first and second sides 38, 40 and each of the first and second ends 34, 36.

The diameter or size of the primary core 42 in combination with the size of the secondary core portions 46, 50 is sufficiently large so as to minimize the weight or mass of angle block 10 and sufficiently small so as to provide sufficient mass and strength to angle block 10 such that a set of angle blocks 10, alone or in combination with other building blocks, can make up a free standing wall.

Endless interlock 54 runs about a perimeter of the primary core 42 on first load bearing face 12 so as to be curved or arcuately shaped so as to cooperate with one of a secondary core wall of an adjacent building block, such as secondary core walls 48, 52 of an adjacent angle block 10, that is placed at an immediately adjoining level. Such a curved or arcuate shape, or more preferably a circular shape, and most preferably an endless circular shape, permits rotational adjustment of angle block 10 relative to another building block while maintaining an interlock between the blocks. Building blocks interlock when two adjacent blocks at the same level are placed end to end, preferably without glue, such that confronting secondary core portions form a secondary core and thus a receptor for endless interlock 54 of a building block, such as angle block 10, at an immediately adjoining level.

It can be seen from a section view that endless interlock 54 includes a cylindrical wall surface portion 70 running parallel and in line with cylindrical wall 44, a top endless surface portion 72 running outwardly from cylindrical wall surface portion 70 and extending generally parallel to load bearing face 30, and a tapering or beveled endless surface 74 tapering from top endless surface portion 72 to load bearing face 30. Again, the seat for endless interlock 54 is a secondary core formed by two secondary core portions. Such a secondary core or seat includes secondary core portion walls, such as walls 48, 52, that run normal to a second load bearing face, such as face 32. The tapering or beveled endless surface 74 aids in aligning endless interlock 54 with the walls of the secondary core portions. The radius of endless interlock 54, measured at the intersection between tapering or beveled endless surface 74 and load bearing face 30, is substantially equal to, and preferably slightly less than, the radius of secondary core walls, such as secondary core walls 48 and 52. As shown in FIGS. 2A and 2B the protruding interlock 54 is not vertically aligned with an end core portion such as secondary core walls 48 or 52. Endless interlock 54 is molded or formed at the same time as angle block 10 such that endless interlock 54 is one-piece with and integral with angle block 10.

Figure 15A:
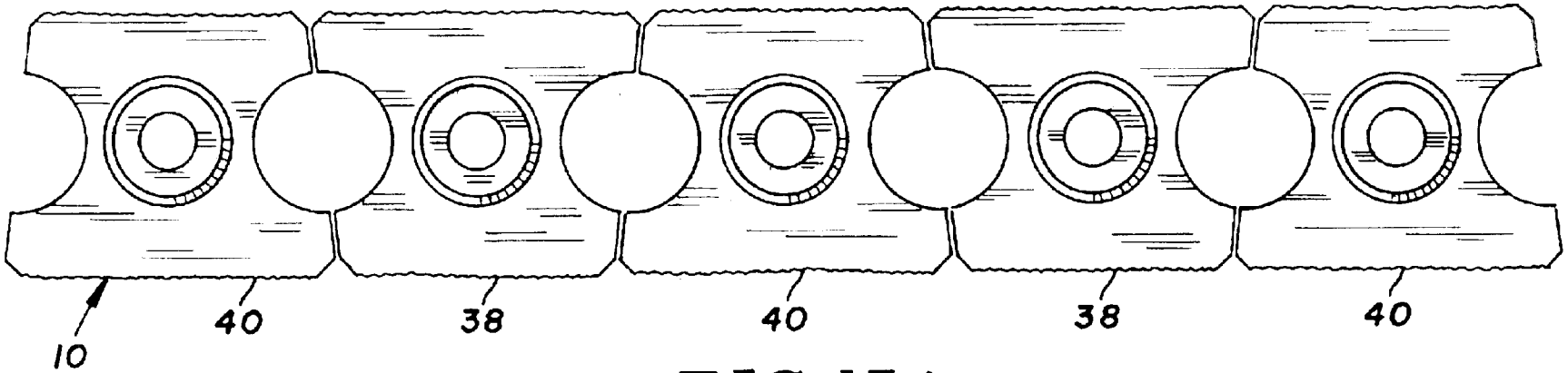
FIG. 15A is a top view of a straight wall portion utilizing the angle block of FIG. 2A.
Figure 16A:
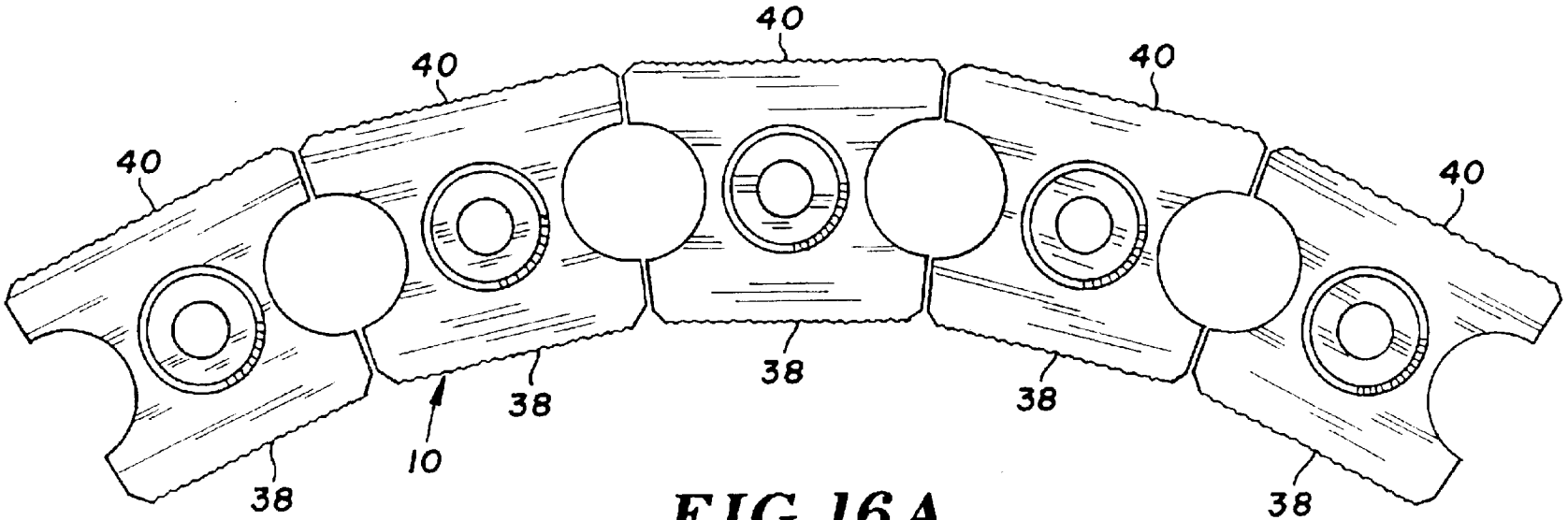
FIG. 16A is a top view of a curved wall portion utilizing the angle block of FIG. 2A.

End 34 is disposed opposite end 36. End 34 includes a first generally flat surface or face 80 and a second generally flat surface or face 82, with each of the flat surfaces 80, 82 running normal to load bearing faces 30, 32. Secondary core portion 46 is formed intermediate the flat surfaces 80, 82. Flat surfaces 80, 82 lie in a plane that is oblique to each of sides 38, 40. End 36 includes a first generally flat portion 84 and a second generally flat surface 86, with each of the flat surfaces 84, 86 running normal to load bearing faces 30, 32. Secondary core portion 50 is formed between the flat surfaces 84 and 86. Flat surfaces 84, 86 lie in a plane that is oblique to each of sides 38, 40. The plane in which flat portions 80, 82 are disposed is oblique relative to the plane in which flat portions 84, 86 are disposed. Each of the flat portions 80, 82, 84, 86 is transverse to or lies at a crosswise direction relative to faces 30, 32 and sides 38, 40. By virtue of the mutually inclining ends 36, 38, a set of angle blocks 10, alone or in combination with other blocks, can form either a curved row of blocks or a straight row of blocks or a combination of both so as to form, for example, an undulating or serpentine row of blocks. As shown in FIG. 16A, a continuously curving row of blocks is formed when each of the sides 38 confronts or is aligned with each of the other sides 38. As shown in FIG. 15A, a straight row of blocks is formed when blocks are placed front-to-back such that side 38 of one block runs into side 40 of the immediately adjacent block that in turn runs into side 38 of the subsequent immediately adjacent block, with such a pattern continuing for a desired length. An undulating row of blocks may be formed by some combination of curved and straight row portions.

Sides 38, 40 of angle block 10 are disposed opposite of each other. Each of the sides 38, 40 is disposed generally in a plane that is generally parallel to the plane of the other side. Each of the sides 38, 40 is transverse to or lies at a crosswise direction relative to load bearing faces 30, 32 and ends 34, 36. Sides 38, 40 form the exterior vertical faces of the free standing wall. Sides 38, 40 are preferably textured so as to form a double-sided textured wall.

Angle Block 12 Having a Splitter Wedge

As shown in FIGS. 3A and 3B, angle block 12 is identical to angle block 10 with the exception of a splitter space or score or recess 90 that cuts across the interlock so as to form a discontinuous interlock 92 having interlock segments 94. Each of the interlock segments 94 has a pair of ends or end faces 96 that are spaced from the ends or end faces 96 of the other interlocking segment 94 so as to therebetween form the splitter space 90. Space 90 runs to and between each of the load bearing faces 30, 32. Space 90 opens to and communicates with the inner core 42.

Space 90 is a marker or aid for splitting angle block 12, such as in the field, into at least two portions along a plane 98 that runs substantially normal to faces 30, 32. Once split, such as with a chisel or other wedged-shaped tool or such as with a saw, right hand straight and left hand straight blocks are formed. Portion or block 100 forms a left hand straight building block and portion or block 102 forms a right hand straight building block such that each of portions 100, 102 have a face formed along plane 98 that is normal to its respective sides 38 and 40 and oblique to its respective surfaces 80, 82 and 84, 86.

Angle block 12 does not require field modification. If available, angle block 10 with the endless interlock 54 is preferred. However, where angle block 10 is not available, angle block 12 may be substituted for the angle block 10.

Mold Layout for Angle Blocks 10 and 12

Figure 4:
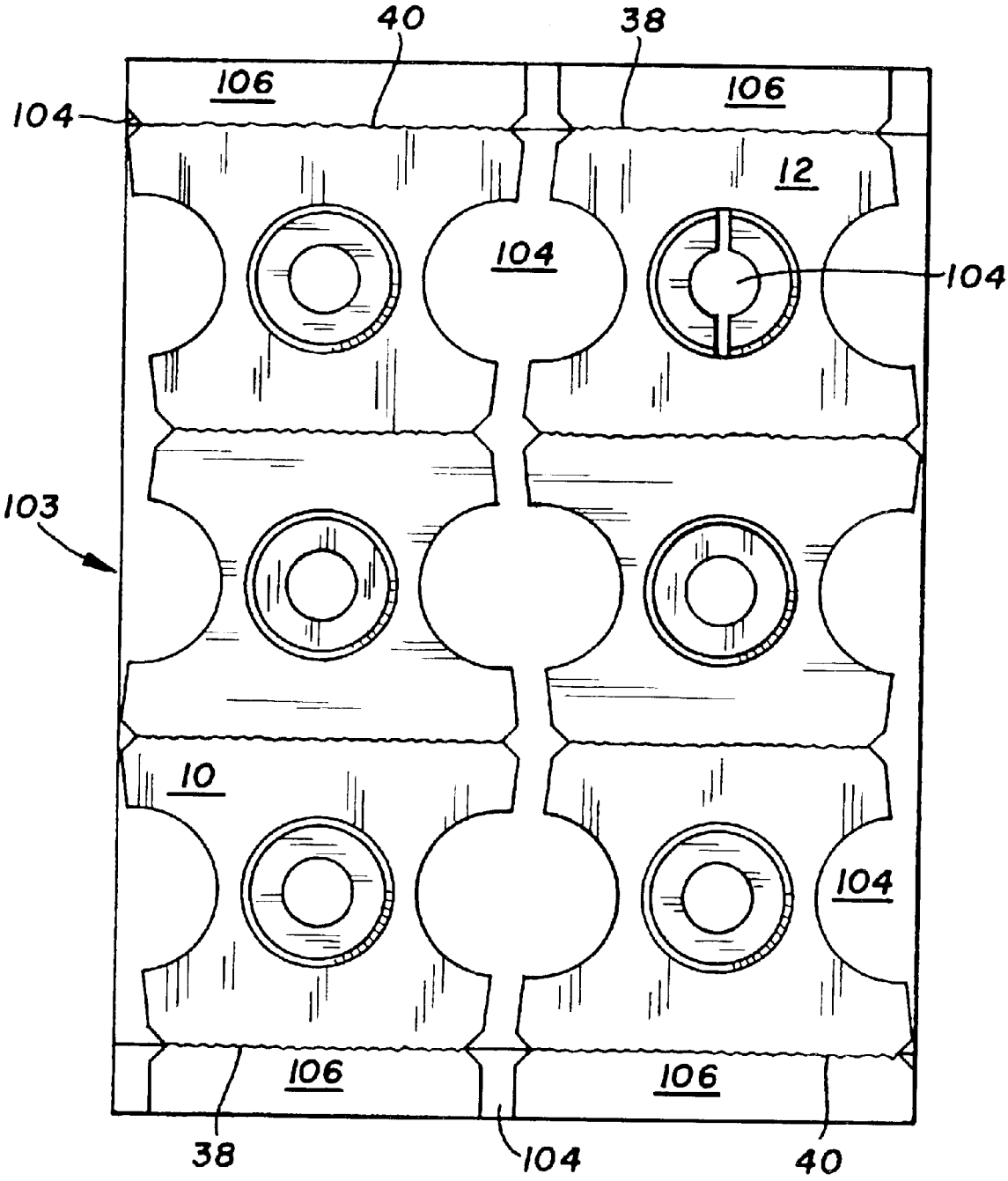
FIG. 4 is a top view of the mold layout for the angle blocks of FIGS. 2A and 3A.

As shown in FIG. 4, a preferred way of forming a texture or a rough masonry face on sides 38, 40 is by splitting blocks molded back to back, such as in a split-face machine. For example, a mold box 103 may be set up such that sides 38 of two different blocks 10 are back to back and such that sides 40 of two different blocks 10 are back to back. Then the blocks 10 are split along sides 38 and sides 40 to create the texture.

In FIG. 4, mold portions are indicated by reference number 104 and confront, for example, at least load bearing surfaces 30, 32, first end 34 including wall 48 and surfaces 80, 82, second end 36 including wall 52 and surfaces 84 and 86, cylindrical wall 44, cylindrical wall portion 70 of interlock 54, top surface 72 of interlock 54, tapering or beveled surface 74, chamfers 56, 58, 60, and 62, and, where interlock segments 94 are formed, ends or end faces 96 and the portions of load bearing surface 30 that run into and between interlock segments 94.

In FIG. 4, excess masonry portions are indicated by reference numbers 106 and are split from their respective faces 38 or 40.

Stretcher Block or Double Unit Block 14

Stretcher or double unit block 14 is shown in FIGS. 5A and 5B. Double unit block 14 includes a first load bearing face 110, a second load bearing face 112, a first end 114, a second end 116, a first side 118, and a second side 120.

Stretcher block 14 further includes a central or relatively large second inner core 122 defined by a cylindrical or core wall 124 and, on either side of the relatively large second inner core 122, a pair of relatively small inner first cores 126, 128 defined by respective cylindrical or core walls 130, 132.

Stretcher block 14 further includes a secondary or end core portion or end arcuate recess or seat 134 defined by a cylindrical or core wall 136 and a secondary or end core portion or end arcuate recess or seat 138 defined by a cylindrical or core wall 140.

Stretcher block 14 further includes an endless interlock 142 about a perimeter of relatively small inner core 126 and an endless interlock 144 about a perimeter of relatively small inner core 128.

Stretcher block 14 further includes four corner faces or chamfers 146, 148, 150 and 152.

First loading bearing face 110 is disposed opposite of second load bearing face 112. Each of the load bearing faces 110, 112 is disposed in a plane that is parallel to the plane of the other load bearing face. Each of the load bearing faces 110, 112 is transverse to or lies at a crosswise direction relative to ends 114, 116. Generally, each of the load bearing faces 110, 112 is a parallelogram. Specifically, each of the load bearing faces 110, 112 is bounded by a set of 12 edges formed by the corner faces or chamfers 146, 148, 150, and 152, the ends 114, 116 having the secondary walls or recesses 136, 138, and the sides 118, 120.

Central core 122 is formed centrally in stretcher block 14 and extends to and between each of the load bearing faces 110, 112. An axis running centrally through central core 122 is equidistant from side 118 and side 120 and is further equidistant from a midpoint on end 114 and a midpoint on end 116.

The diameter or size of the central core 122, in combination with the diameter or size of relatively small inner cores 126, 128, and further in combination with the diameter or size of secondary core portions 134, 138, is sufficiently large so as to minimize the weight or mass of stretcher block 14 and sufficiently small so as to provide sufficient mass and strength to stretcher block 14 such that a set of stretcher blocks 14, alone or in combination with other building blocks, can make up a free standing wall.

Each of cores 122, 126 and 128 is an inner core. That is, each of cores 122, 126, 128 is spaced from each of the first and second sides 118, 120 and each of cores 122, 126 and 128 is spaced from each of the ends 114, 116. Each of the cores 122, 126 and 128 is spaced from each other.

Each of the endless interlocks 144 runs about the perimeter of its respective inner cores 126 and 128 on first load bearing face 110 so as to be curved or arcuately shaped so as to cooperate with one of a secondary core wall of an adjacent building block that is placed at an immediately adjoining level. Such a curved or arcuate shape, or more preferably a circular shape, and most preferably an endless circular shape, permits rotational adjustment between confronting building blocks while maintaining an interlock between the blocks. Stretcher block 14 interlocks with other building blocks when two adjacent blocks are placed end to end, preferably without glue, such that confronting secondary core portions form a secondary core and thus a receptor for one of the endless interlocks 142 at an immediately adjoining level.

The endless interlocks 142, 144 are identical in shape to endless interlock 54 and include a cylindrical wall surface portion 154 running parallel and in line with its respective cylindrical wall 130, 132, a top endless annular surface portion 156 running outwardly from cylindrical wall surface portion 154 and extending parallel to load bearing face 110, and a tapering or beveled endless surface 158 tapering from top endless surface portion 156 to first load bearing face 110.

One seat for endless interlocks 142, 144 is a secondary core formed by two confronting secondary core portions.

Such a secondary core or seat includes secondary core portion walls, such as walls 48 and 52 of angle block 10 or angle block 12 or walls 136 and 140 of stretcher block 14, stretcher block 16, and stretcher block 18, or secondary core portion walls of corner block 20. These secondary core portion walls run normal to a second load bearing face, such as face 112.

Another seat for endless interlocks 142, 144 is the cylindrical wall 124 of primary core 122. Cylindrical wall 124 of primary core 122 is also a seat for the endless interlock 54 or the discontinuous interlock 92 or any of the interlock segments 94.

Like endless interlock 54, endless interlocks 142 and 144 include the tapering or beveled endless surface 158 that aids in aligning endless interlocks 142 and 144 with the walls of the secondary core portions. Like endless interlock 54, each of endless interlocks 142 and 144 have a radius, measured at the intersection between tapering surface 158 and first load bearing face 110, that is substantially equal to, and preferably slightly less than, the radius of secondary core walls, such as secondary core walls 48, 52, 136 and 140. Endless interlocks 142 and 144 are molded or formed at the same time as stretcher block 14 such that endless interlocks 142 and 144 are one-piece and integral with stretcher block 14.

End 114 is disposed opposite end 116. End 114 includes a first face or generally flat surface 160 and a second face or generally flat surface 162, with each of the flat surfaces 160, 162 running normal to load bearing faces 110, 112. Secondary core portion 134 is formed intermediate the flat surfaces 160, 162. Flat surfaces 160, 162 lie in a plane that is oblique to each of sides 118 and 120.

End 116 includes a first face or generally flat surface 164 and a second face or generally flat surface 166, with each of the flat surfaces 164, 166 running normal to load bearing faces 110, 112. Secondary core portion 138 is formed intermediate the flat surfaces 164, 166. Flat surfaces 164, 166 lie in a plane that is oblique to each of sides 118 and 120.

The plane in which the pair of flat surfaces 160, 162 lies is parallel to the plane in which the pair of flat surfaces 164, 166 lies.

Each of the flat portions 160, 162, 164 and 166 is transverse to or lies at a crosswise direction relative to faces 110, 112 and sides 116, 118.

By virtue of the ends 114, 116 having parallel flat surfaces, stretcher blocks 14 placed end to end form a straight line or straight wall portion. In such a straight wall portion, since ends 114, 116 have parallel flat surfaces, sides 118 may be aligned with each other or side 118 may be aligned with side 120.

On top of such a straight wall portion, other stretcher blocks 14 may be placed in a staggered relationship such that one of the endless interlocks 142, 144 of a lower block 14 is seated in a secondary core formed by two confronting secondary core portions 134 and 138 of the upper straight wall portion and such that the other of the endless interlocks 142, 144 of the upper block 14 is seated in a central core 122 of an upper block 14. Such a staggered relationship forms an interlocking wall of building blocks.

Stretcher block 14 may be used in combination with angle blocks 10, 12 to provide curves in walls or undulating or serpentine patterns in walls formed by blocks 10, 12, 14, 16, 18, and 20.

Sides 118, 120 of stretcher block 14 are disposed opposite of each other. Each of the sides 118, 120 is disposed generally in a plane that is generally parallel to the plane of the other side. Each of the sides 118, 120 is transverse to or lies at a crosswise direction relative to load bearing faces 110, 112 and ends 114, 116. Sides 118, 120 form the exterior vertical faces of the free standing wall. Sides 118, 120 are preferably textured so as to form a double-sided textured wall.

Stretcher Block or Double Unit Block 16 Having a Splitter Wedge at the Primary Core As shown in FIGS. 6A and 6B, stretcher block 16 is identical to stretcher block 14 with the exception of a pair of splitter wedges or recesses 170 at the central core 122. Splitter wedges 170 are aligned with each other and are disposed in a plane that runs normal to load bearing faces 110, 112 and to sides 118, 120. Each of the recesses 170 runs to and between the first and second load bearing faces 110, 112. Each of the recesses 170 communicates with or opens to the central core 122.

Splitter wedges 170 serve as an aid for field modification of stretcher block 16. That is, by splitting block 16 along the plane defined by the pair of splitter wedges 170, a left hand straight block or block portion 172 and a left hand straight block or block portion 174 is formed, with each of the newly formed blocks 172, 174 having secondary wall portions or seats for interlocks.

It should be noted that stretcher block 16 does not require field modification and may, if desired, be used in the same manner as stretcher block 14.

Stretcher Block or Double Unit Block 18 Having a Splitter Wedge at One Interlock As shown in FIGS. 7A and 7B, stretcher block 18 is identical to stretcher block 14 with the exception of a splitter wedge 180 (or recesses 180) so as to form a discontinuous interlock 182 having a pair of interlocking segments 184, 186.

Discontinuous interlock 182 is the same as discontinuous interlock 92 such that one interlocking segment 184 has a pair of ends or end faces 188 that are spaced from the ends or end faces 188 of the other interlocking segment 186 so as to therebetween form the splitter wedge or space or recess 180. Space 180 runs to and between each of the load bearing faces 110, 112. Space 180 opens to and communicates with the inner core 128.

Splitter wedge 180 is a marker or aid for splitting stretcher block 18 into a one-quarter portion or left hand straight block 190 and a three-quarter portion or left hand straight block 192. Spaces 180 are aligned with each other on a plane running normal to ends 110, 112 and sides 118 and 120. Once split, the blocks 190 and 192 have end faces that run normal to ends 110, 112 and sides 118 and 120.

It should be noted that stretcher block 18 does not require field modification and may, if desired, be used in the same manner as stretcher block 18.

Mold Layout for Stretcher Blocks 14, 16, and 18

Figure 8:
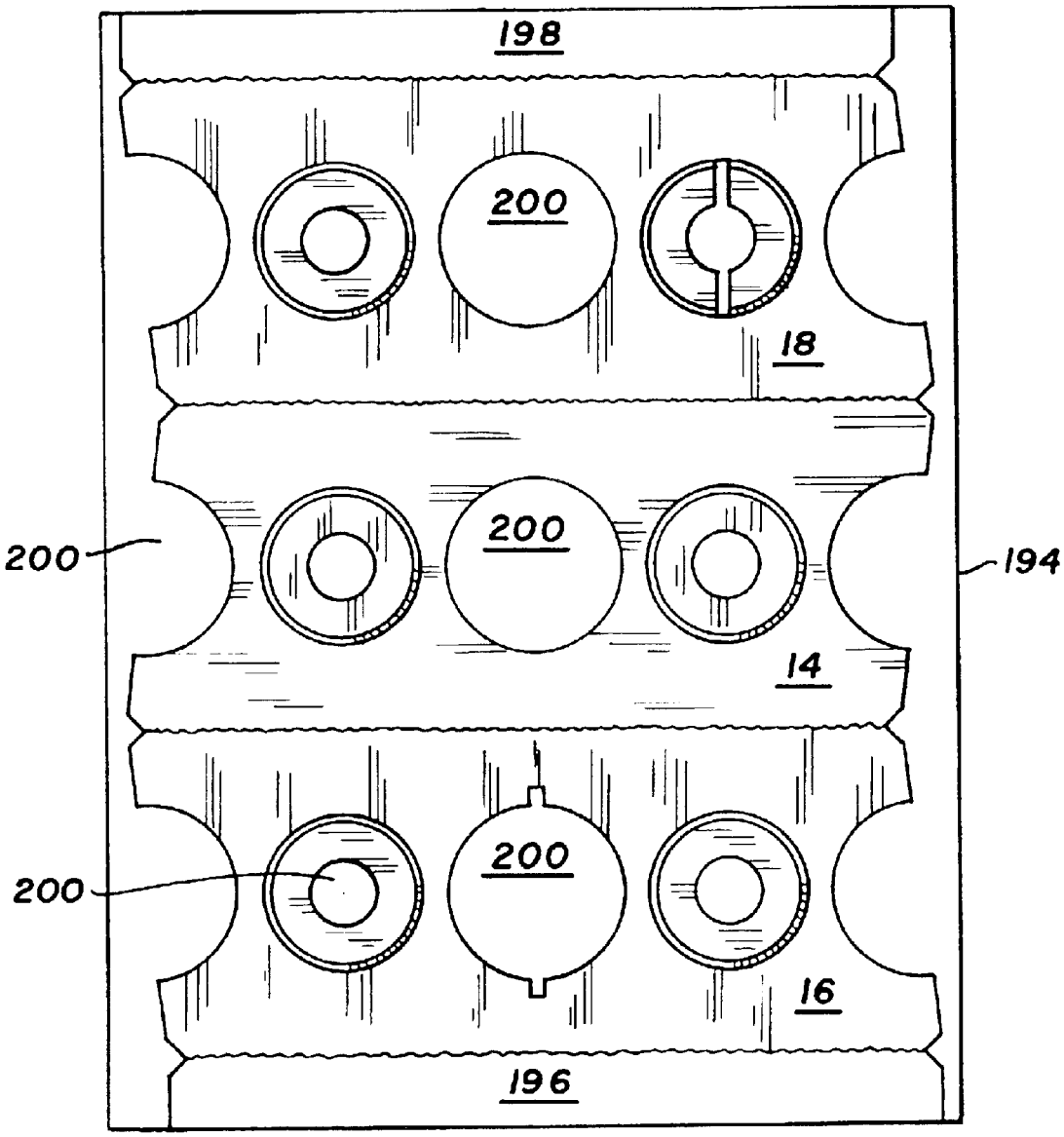
FIG. 8 is a top view of a mold layout for the stretcher blocks of FIGS. 5A, 6A and 7A.

As shown in FIG. 8, a preferred way of forming a texture or a rough masonry face on sides 116, 118 is by splitting one or more stretcher blocks 14, 16, and 18 molded back to back, such as in a split-face machine. For example, mold box 194 includes a layout having a stretcher block 14, a stretcher block 16 and a stretcher block 18 where sides of blocks 14 and 16 are formed by a split and where sides of blocks 14 and 18 are formed by a split. One side of block 16 is formed by a split with an excess masonry portion 196. One side of block 18 is formed by a split with an excess masonry portion 198. Other portions of blocks 14, 16 and 18 confront mold portions 200 and these other portions of blocks 14, 16 and 18 include at least the faces 110, 112, ends 114, 116, cylindrical wall 124 of the central core 122, cylindrical walls 130, 132 of the relatively small inner cores 126 and 128, interlocks 142 and 144, chamfers 146, 148, 150, and 152 and, in block 16, recesses 170, and further, in block 18, recesses 180.

Corner Block 20

As shown in FIGS. 9A and 9B, corner block 20 generally includes a first load bearing face 202, a second load bearing face 204, a first end 206, a second end 208, a first side 210 and a second side 212. Corner block 20 further includes a central or primary or inner core 214 defined by a cylindrical wall 216 and an inner core 218 defined by a cylindrical wall 220. Corner block 20 further includes four corner faces or chamfers 222, 224, 226 and 228 that are disposed in planes normal to load bearing faces 202, 204.

First load bearing face 202 is disposed opposite of second load bearing face 204. Each of the load bearing faces 202, 204 is disposed in a plane that is parallel to the plane of the other load bearing face. Each of the load bearing faces 202, 204 is transverse to or lies at a crosswise direction relative to ends 206, 208. Generally, each of the load bearing faces 202, 204 is trapezoidal. Specifically, each of the load bearing faces 202, 204 is bounded by a set of ten edges formed by chamfers 222, 224, 226, 228, flat end 206, end 208 having a secondary core portion, and sides 210, 212.

Central core 214 is generally formed centrally in corner block 20 and extends to and between each of the load bearing faces 202 and 204. An axis running centrally through central core 214 is equidistant from sides 210 and 212 and is further generally equidistant from ends 206 and 208.

More particularly, an axis 229 running centrally through central core 214 and an axis 231 running centrally through inner core 218 are spaced from each other by a distance equal to the distance between axis 231 and axis 233, which runs centrally through a secondary core portion 230 of end 208, where secondary core portion 230 is defined by cylindrical wall 232.

Such set distance between axis 229 and 231 and between axis 231 and 233 is also the set distance between 1) the axis of core 42 and the axis of each of the secondary core portions 46, 50 of angle blocks 10 and 12; 2) the axis of central core 122 and the axis of each of the inner cores 126 and 128 of stretcher blocks 14, 16 and 18; 3) the axis of inner core 126 and the axis of secondary core portion 138 of stretcher blocks 14, 16 and 18; 4) the axis of inner core 128 and the axis of secondary core portion 134 of stretcher blocks 14, 16 and 18.

The diameter or size of the central core 214 in combination with the inner core 218 is sufficiently large so as to minimize the weight or mass of the corner block 20 and sufficiently small so as to provide sufficient mass and strength to corner block 20 such that a set of corner blocks, alone or in combination with other building blocks, can make up a free standing wall.

Corner block 20 does not include an interlock such as interlock 54. However, cylindrical wall 220 of inner core 218 is the same diameter as the cylindrical walls of 1) 44 and 70 of angle blocks 10 and 12; and 2) cylindrical walls 130 and 132 of stretcher blocks 14, 16, and 18 such that piping can be introduced through inner core 218 and cores of other blocks 10, 12, 14, 16, 18 and 20.

It should further be noted that cylindrical wall 216 of central core 214 has the same radius as secondary core portion 230, which radius is the same as 1) secondary core portions 46, 50 of angle blocks 10 and 12; and 2) central core 122 and secondary core portions 134 and 138 of stretcher blocks 14, 16 and 18.

It should further be noted that central core 214, like other central or primary cores, is a seat for a continuous interlock or one or more interlocking segments.

It should further be noted that secondary core portion 230, like other secondary core portions, is a seat for a continuous interlock or one interlocking segment.

End 206 is disposed opposite of end 208. End 206 is flat and runs in a plane normal to load bearing faces 202, 204 and sides 210, 212. End 208 includes a first flat surface 234 and a second flat surface 236, with each of the flat surfaces 234, 236 running normal to load bearing faces 202, 204. Secondary core portion 230 is formed intermediate the flat surfaces 234, 236. Flat surfaces 234, 236 lie in a plane that is oblique to each of sides 210, 212 and that is further oblique to the plane in which flat end 206 lies. Each of the flat surfaces 234, 236 is transverse to or lies at a crosswise direction to faces 202, 204 and sides 210, 212.

By virtue of flat end 206 and oblique end 208 having an interlock seat or secondary core portion 230, corner block 20 may form a portion of a corner or end of a free standing wall, with flat end 206 possibly being a terminal portion of the corner or end of the free standing wall. Such a free standing wall or row of building blocks may then run from oblique end 208.

Sides 210, 212 of corner block 20 are disposed opposite of each other. Each of the sides 210, 212 is disposed generally in a plane that is generally parallel to the plane of the other side. Each of the sides 210, 212 is transverse to or lies at a crosswise direction relative to load bearing faces 202, 204 and ends 206, 208. Sides 210, 212 and flat end 206 for exterior vertical faces of a free standing wall and are preferably textured so as to form a double-sided textured wall with corners or ends that are also textured.

Corner block 20 may be used "right-side up" or "upside-down." In other words, either of the load bearing sides may be above the other. Likewise, blocks 10, 12, 14, 16, and 18 may be used with either of the load bearing sides at a higher level.

Mold Layout for Corner Block

Figure 10:
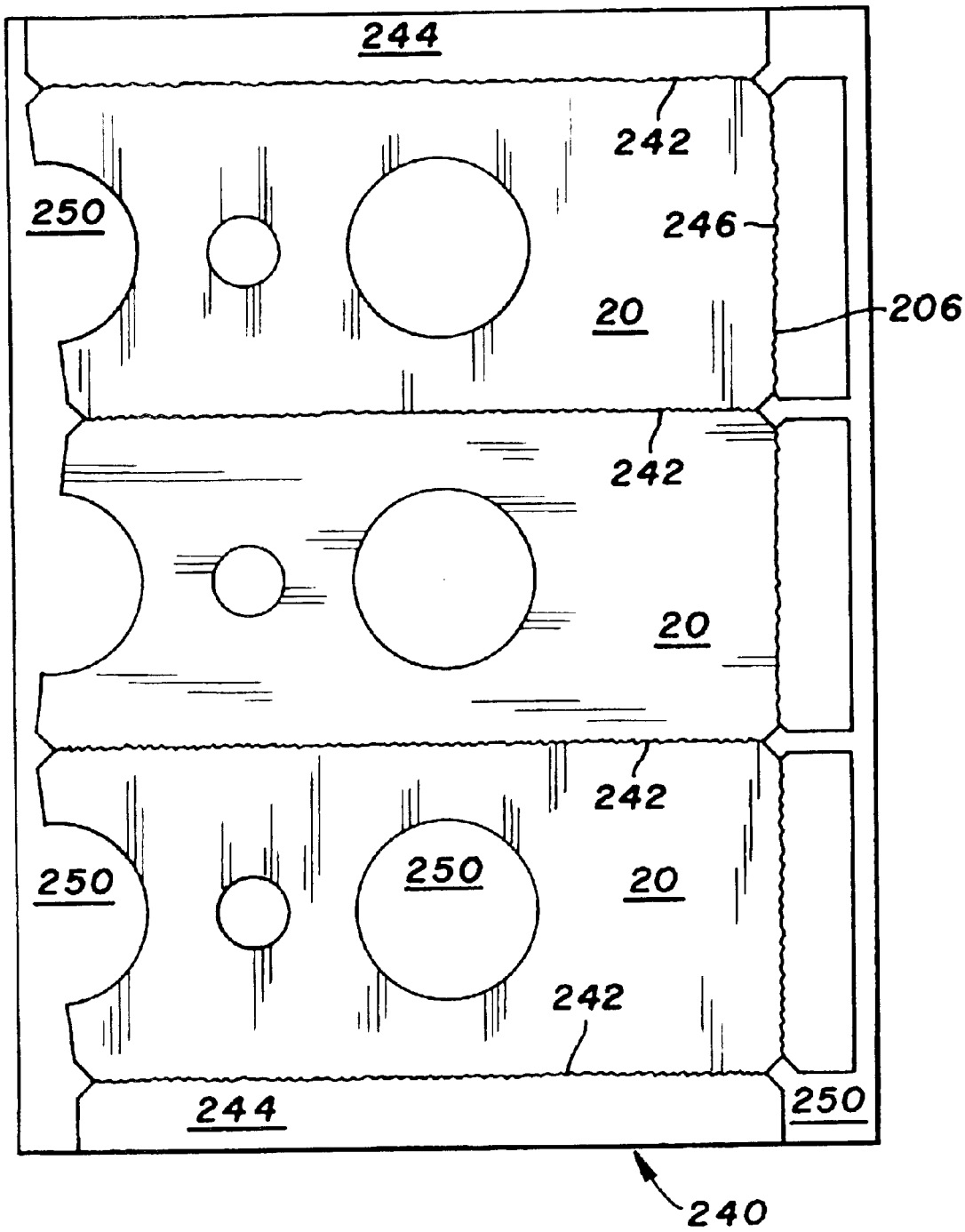
FIG. 10 is a top view of a mold layout for the corner block of FIG. 9A.

As shown in FIG. 10, a mold layout 240 for corner block 20 includes three corner blocks 20 having split lines or planes 242 for forming one or more of the textured sides 210, 212. Two of the split planes 242 divide a corner block 20 from an excess masonry portion 244.

Mold layout 240 further includes split lines or planes 246 for forming flat end 206 and that divide flat end 206 from an excess masonry portion 248.

Remaining portions of corner block 20 confront mold portions 250 and these other portions includes at least the load bearing faces 202, 204, the end 208 having the secondary core portion 230, cylindrical wall 216 of central relatively large core 214, cylindrical wall 220 of inner relatively small core 218, and chamfers 222, 224, 226 and 228.

Cap Block 22

As shown in FIGS. 11A and 11B, a cap or cap block 22 is placed on an uppermost building block or uppermost row of building blocks 10, 12, 14, 16, 18 and/or 20. Cap 22 includes two ends 260 and 262 that are mutually inclined relative to each other and that are coplanar with, or preferably extend slightly beyond ends 34 and 36 of angle blocks 10, 12 when cap 22 is placed on top of angle block 10 or 12. Cap 22 further includes an upper flat face 264 that is opposite of a lower face 266 that includes two flat portions 268, 270 with a track 272 intermediate the flat portions 268, 270. Flat portions 268, 270 are disposed in a plane that is generally parallel to a plane in which upper flat face 264 lies. Cap 22 further includes sides 274, 276 that are opposite of each other and that are disposed in planes that run parallel to each other and normal to flat portions 268, 270. Track 272 is a receptor for an interlock, such as endless interlock 54, discontinuous interlock 92, endless interlocks 142, 144, and discontinuous interlock 182. When cap 22 is engaged on one of the building blocks, tapered track portions 278 confront tapered portions of such interlocks or interlock segments.

It should be noted that width of cap 22 (distance between sides 274 and 276) is greater than the width of any of the building blocks 10, 12, 14, 16, 18 and 20 (distance between the sides of such blocks) such that the cap 22 overhangs such building blocks.

It should be noted that cap 22 may or may not be placed directly over respective building blocks, but that the caps 22 may be placed in a staggered fashion relative to building blocks immediately below. In other words, in a row of building blocks, a line is formed where two ends of adjacent building blocks confront. A cap 22 may be placed directly over such a line to conceal the location where adjacent building blocks confront each other.

Figure 18A:
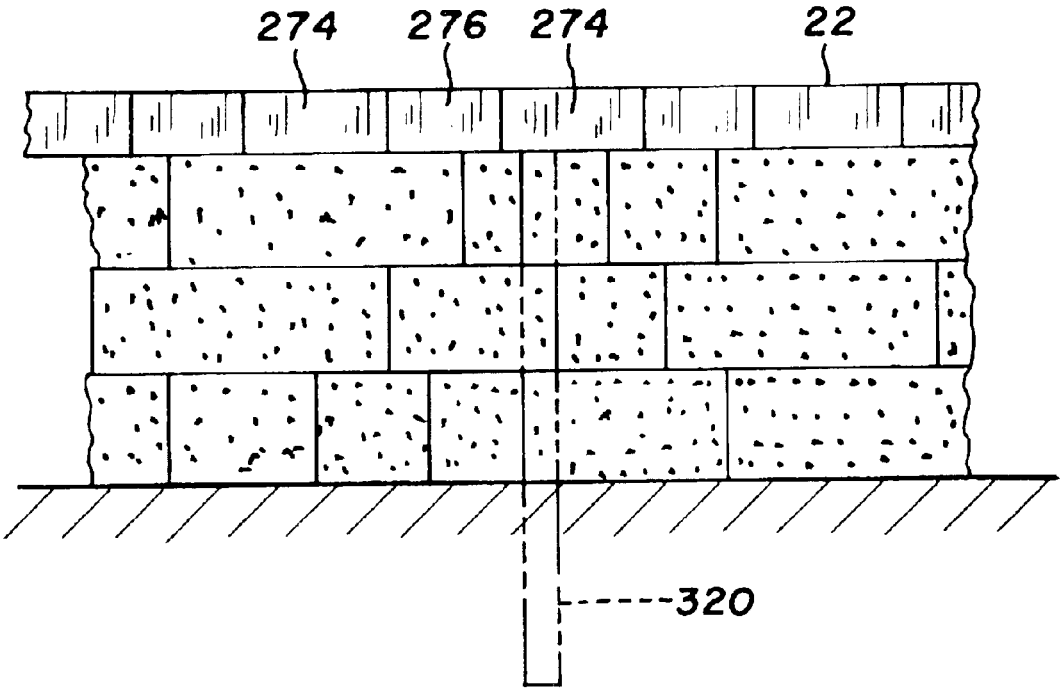
FIG. 18A shows a portion of the wall utilizing piping for resistance to over-turning of the wall.

FIG. 18A shows cap blocks 22 placed to form a cap of a straight wall portion such that side 260 of one cap block 22 confronts side 262 of the other cap block 22.

Mold Layout for Cap Block

Figure 12:
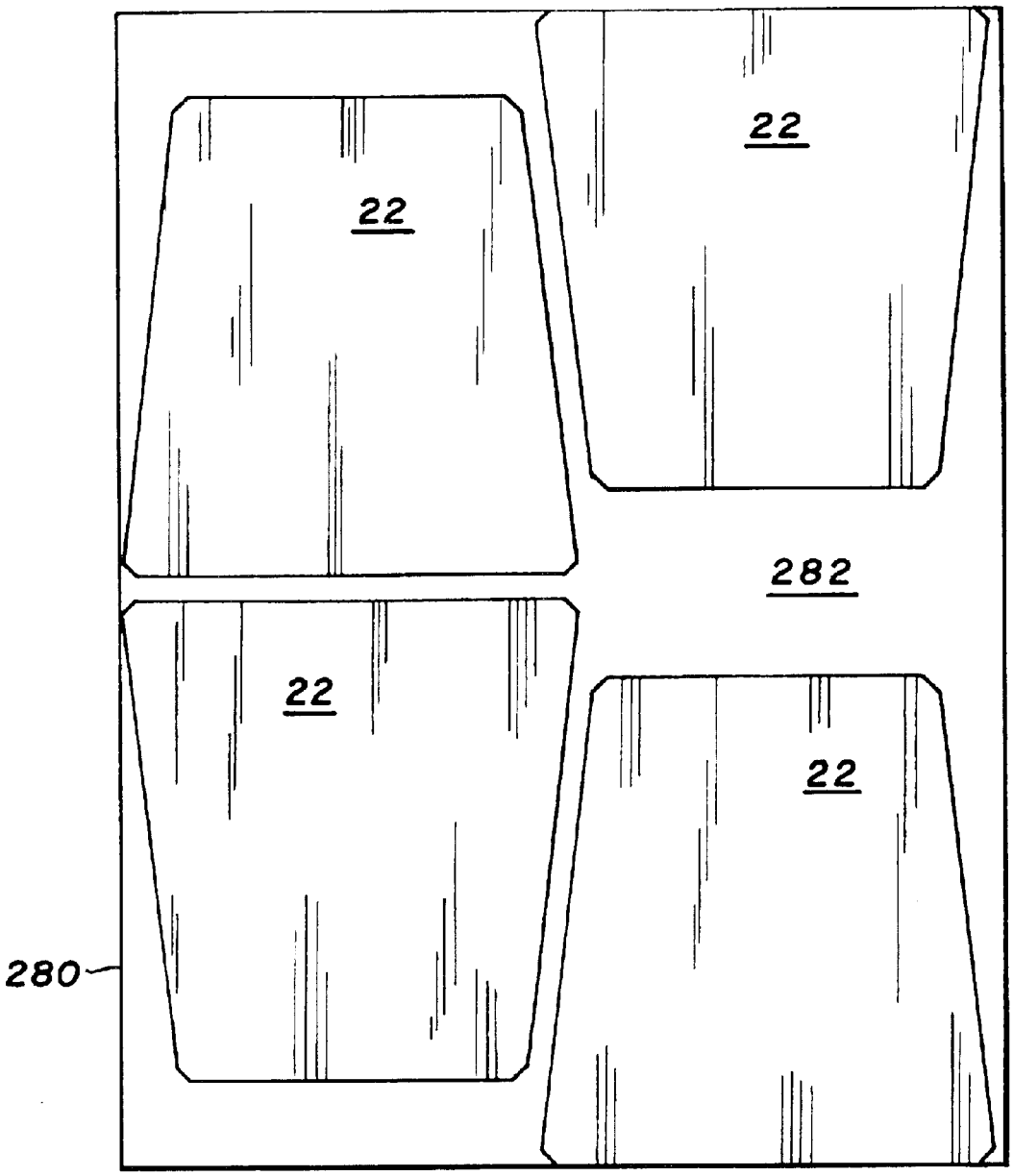
FIG. 12 is a top view of a mold layout for the cap block of FIG. 11A.

As shown in FIG. 12, cap or cap block 22 preferably includes no texture. Accordingly, in a mold layout 280, where four caps or cap blocks 22 are formed, the cap blocks 22 are spaced from each other and no splits are formed anywhere. Mold portions 282 confront every surface of the cap or cap block 22.

Post Cap Block 24

Figure 13C:
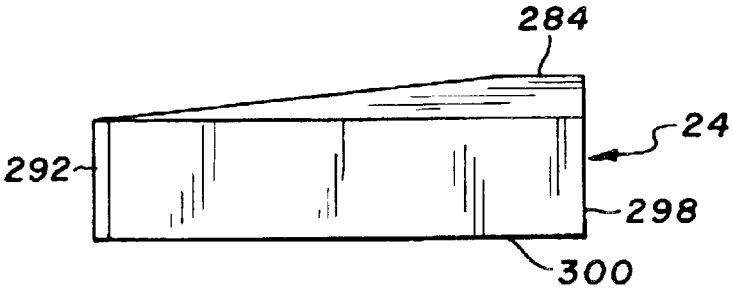
FIG. 13C is a side view of the post cap block of FIG. 13A.

Post cap block 24 is shown in FIGS. 13A, 13B and 13C. Post cap block 24 includes an upper rectangular flat surface 284 and a set of three inclined surfaces 286, 288 and 290 leading downwardly and outwardly from the upper rectangular flat surface 284. Surface 286 leads into a full length side 292 and surfaces 288 and 290 each lead into respective half length sides 294 and 296. Surfaces 288 and 290 further lead into a back side 298. Post cap block 24 further includes a flat bottom surface 300.

Figure 17A:
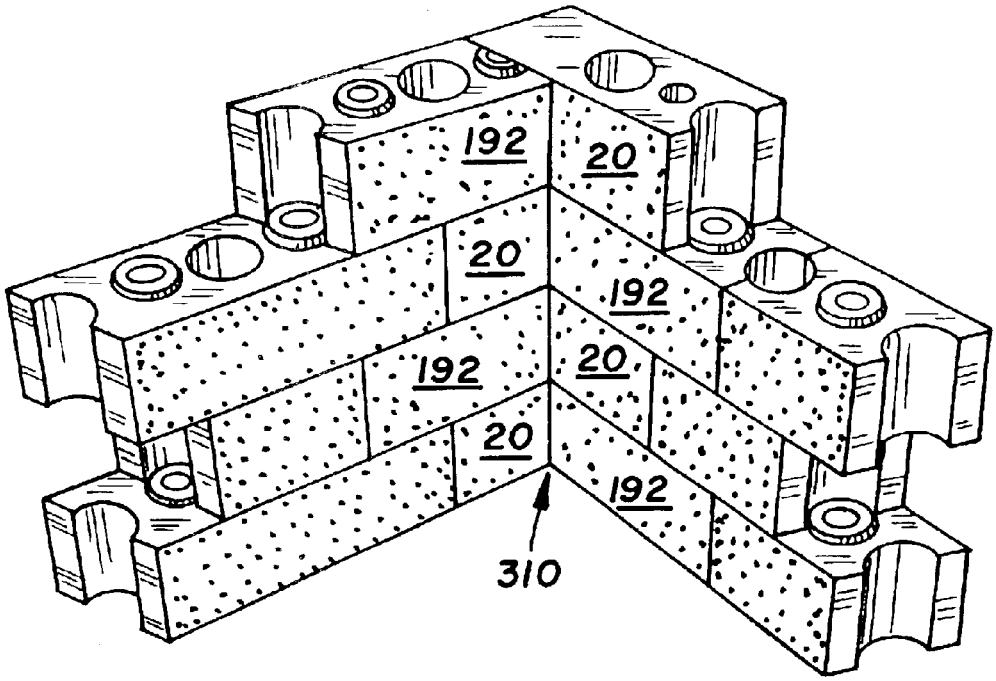
FIG. 17A shows a portion of a corner of a wall formed by corner blocks of FIGS. 9A and 9B.
Figure 17B:
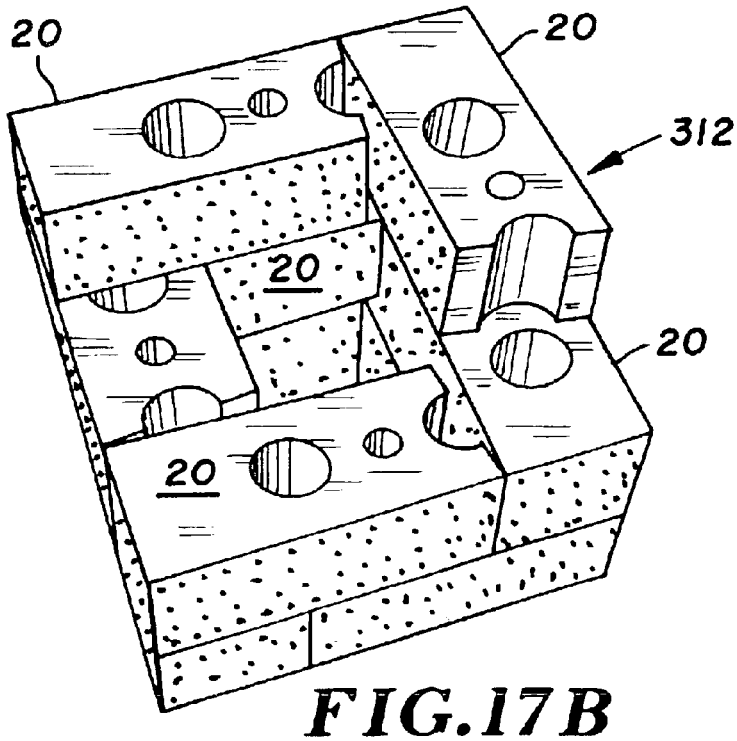
FIG. 17B shows a masonry post formed by corner blocks of FIGS. 9A and 9B.

When two post cap blocks 24 are placed back to back such that back sides 298 confront each other, a post cap is formed so as to be placed on top of a post, such as post 312 (shown in FIG. 17B in the process of being built). Such a post cap includes a square top flat surface formed by two surfaces 284 and four inclined surfaces extending downwardly and outwardly from the square top flat surface, where two of the four inclined surfaces are two surfaces 286 and where the other two of the four inclined surfaces are formed by one surface 288 confronting one surface 290 and by another surface 288 confronting another surface 290. Post cap thereby has the appearance of a crown. The surface of such a crown is defined by such four inclined or trapezoidal areas converging upwardly toward the square flat surface that may be utilized for mounting a light fixture. The cap post building block 24 is preferably glued or otherwise fixed to the flat surfaces of upper portions of a post, where such post is most preferably formed by corner blocks 20 or by a combination of building blocks 10, 12, 14, 16, 18, and 20. Post cap block 24 preferably has a length and width sufficient so as to extend beyond one, two, three or four sides of a post.

Mold Layout For Post Cap Block

Figure 14:
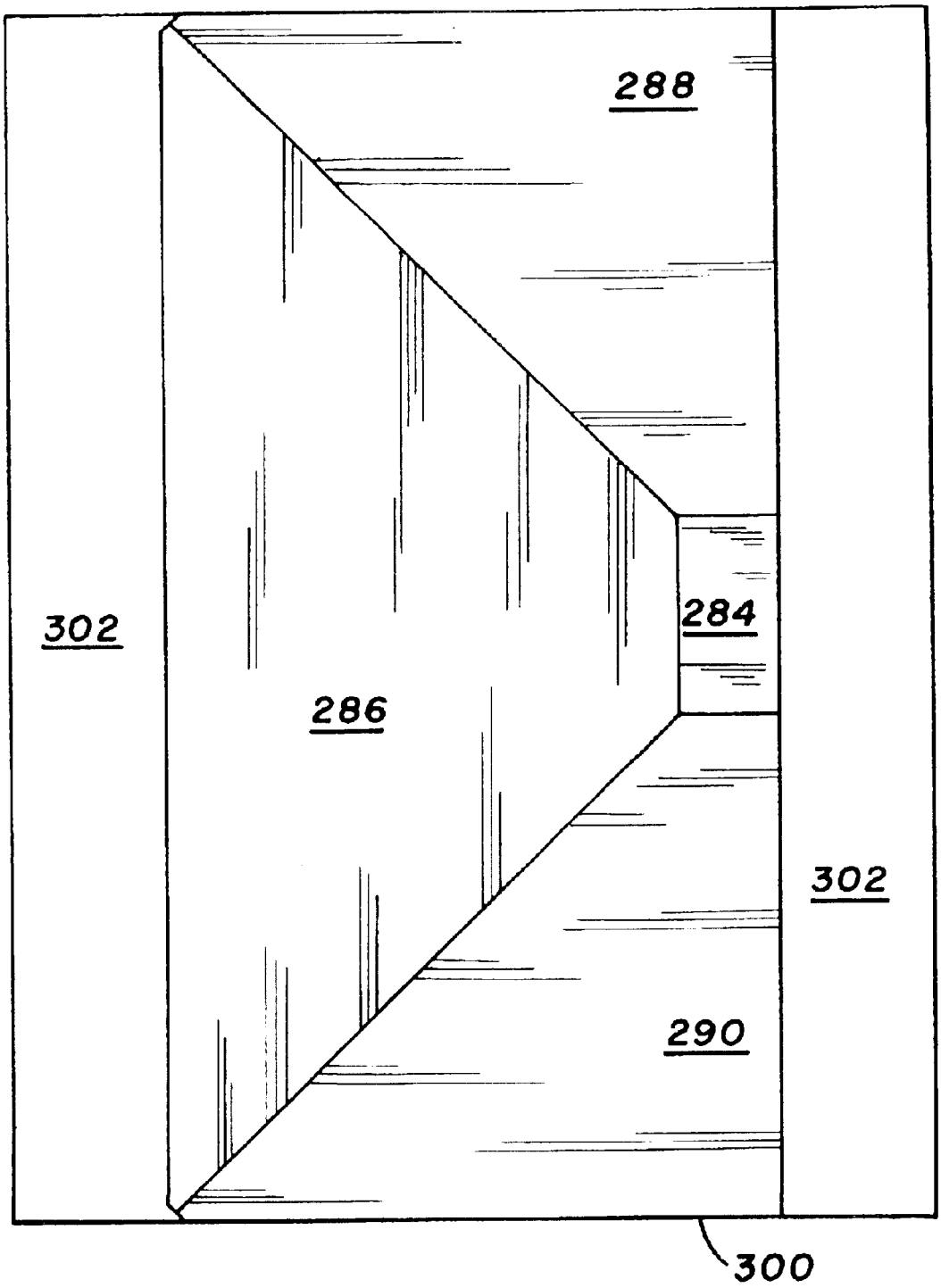
FIG. 14 is a top view of the mold layout for the post cap block of FIG. 13A.

A mold 300 for the post cap block 24 is shown in FIG. 14. Post cap block 24 preferably includes no textured portions. Accordingly, all surfaces of the post cap block 24 are confronted by mold 300 or mold portions 302.

A Straight Wall

FIG. 15A shows a straight wall portion formed by a set of angle blocks 10. In such a straight wall portion or lower row of angle blocks 10, the first relatively short side 38 of one angle block 10 confronts the relatively long side 40 of an adjacent block, which in turn confronts the first relatively short side 38 of another angle block 10. An upper row of angle blocks 10 may be interlocked with the straight wall portion shown by offsetting the upper row of angle blocks a distance of one-half of the length of an angle block 10 such that the endless interlocks 54 of the lower row of angle blocks 10 are seated in secondary cores formed by confronting secondary core portions 46, 50 of confronting upper angle blocks 10.

Figure 15B:
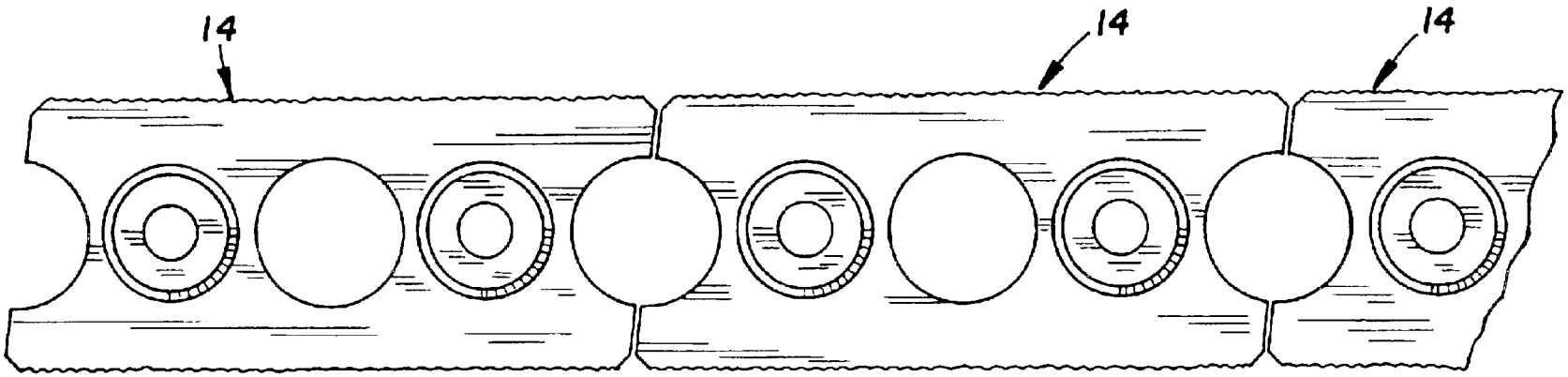
FIG. 15B is a top view of a straight wall portion utilizing the stretcher block of FIG. 5A.

FIG. 15B shows a straight wall portion formed by stretcher blocks 14. Another straight wall portion of stretcher blocks 14 may be placed on the first mentioned or lower straight wall portion, with the second mentioned or upper straight wall portion being offset the distance of one-quarter of a stretcher block from the lower straight wall portion such that the interlocks 142, 144 of the stretcher blocks 14 of the lower straight wall portion are seated in central core 122 and secondary core portions 134 and 138 of the upper building blocks. Such an offset and interlock continues with each row of stretcher blocks 14.

A Curved Wall

FIG. 16A shows a curved wall portion or upper row formed by angle blocks 10 where the relatively short sides 38 of the angle blocks 10 confront each other and where the relatively long sides 40 confront each other. An upper row of angle blocks 10 is interlocked with the lower row by offsetting the upper row by a distance of one-half of an angle block 10 such that the endless interlocks 54 of the lower row are seated in the secondary cores formed by secondary core portions 46, 50 of the upper row.

Figure 16B:
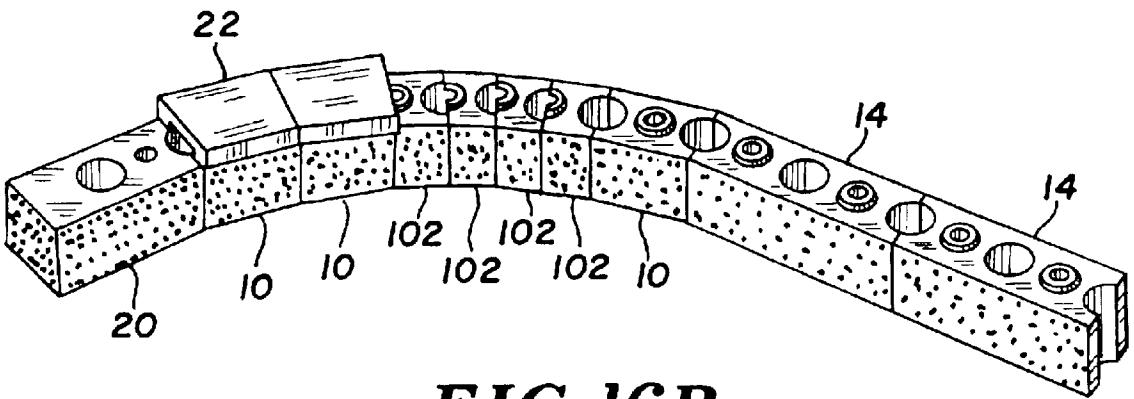
FIG. 16B is a top view of a curved wall portion utilizing the angle block of FIG. 2A, a portion of the angle block of FIG. 3A, the stretcher block of FIG. 5A, and the corner block of FIG. 9A.

FIG. 16B shows a curved wall portion formed by angle block 10, stretcher block 14, block 102 (a field modified version of block 12) and a corner block 20 placed "upside-down." It should be noted that curves of a great variety of different slopes may be formed by confronting different ends of different blocks and their field modified versions.

A Corner

Corner wall portions, such as corner wall portion 310 is shown in FIG. 17A, may be formed utilizing corner blocks 20 (having texture on two sides and an end) with field modified block or three quarter block 192 where each of the corner block 20 and field modified block 192 are staggered as the corner 310 is formed. Extending from the corner 310 (or corner block/field modified block combination), may be one or more of the angle blocks 10, angle blocks 12, stretcher blocks 14, stretcher blocks 16, and stretcher blocks 18 (all of which have texture on two sides). The corner blocks 20 form the extreme corner of the corner wall portions and the remaining blocks tie into the corner blocks 20 with one or more interlocks, such as interlocks 54, 92, 142, 144, and 182 (including interlock segments 184, 186). Posts may be inserted through aligned cores of the blocks and further into the ground to provide resistance to overturning of the corner wall portion.

A Post

FIG. 17B shows a masonry post 312 formed by the corner blocks 20. Each of the sides of the post 312 is formed by staggered layers of a side 212 of one corner block 20 and an end 206 of another corner block 20. Glue and/or piping may be used to interlock the corner blocks 20 to each other. A piece of pipe may extend through inner cores 231 that are aligned with each other and/or through the central cores 214 and second core portions 230 that are aligned with each other.

Each of the masonry posts 312 includes a pair of post caps blocks 24 placed end to end so as to form a post cap. The post cap preferably is sufficiently large so as to somewhat overhang the sides of the post.

Piping

As shown in FIG. 18A, piping 320, where used, such as shown in FIG. 18A, may be a piece of steel tubular piping and may have an outside diameter of preferably about one and three-eighths of an inch. The outside diameter of the piping preferably is slightly less than or equal to the inside diameter of the interlocks of the present invention, such as endless interlock 54 whereupon piping confronts every other block of the present invention. In other words, piping extends through and confronts an interlock of one block, then immediately extends through a primary core or secondary core portion of an immediately adjoining block, then immediately extends though and confronts the interlock of the next block in the next level.

Such piping is easily cut by a pipe cutter in the field. Piping may be preferred where walls or wall portions are greater than about three or about four feet in height.

Random Looks

Figure 18B:
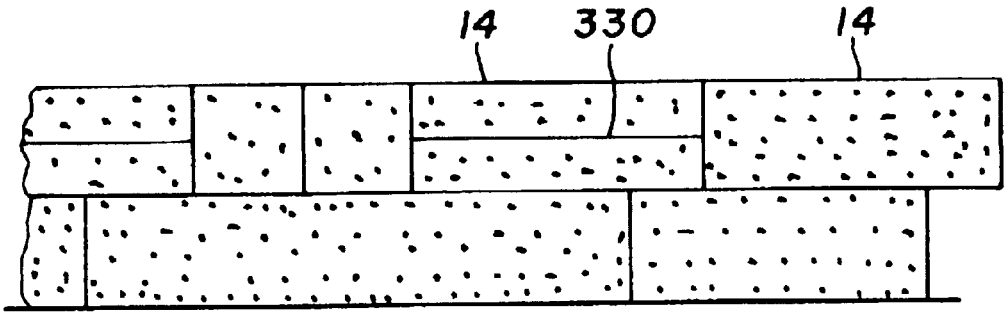
FIG. 18B shows how a random look can be provided to a wall utilizing blocks of the present invention.

FIG. 18B shows how a wall portion of the present invention may have a random look. Such a wall can have one of more of angle blocks 10, one or more of angle blocks 12 and/or its field modified versions, one or more of stretcher blocks 14, one or more of stretcher blocks 16 and/or its field modified versions, one or more of stretcher blocks 18 and/or its field modified versions, one or more of corner blocks 20, and one or more of cap blocks 22.

Further, one or more of the blocks in the random look may have scores 330 formed in the surface to provide the appearance of a half-block when in actuality the block is a full block, such as stretcher block 14. As to forming such a score 330, the following U.S. patents are incorporated by reference in their entireties: the Bott U.S. Pat. No. 6,082,067 issued Jul. 4, 2000 and entitled Dry Stackable Block Structures and the Bott U.S. Pat. No. 6,322,742 issued Nov. 27, 2001 and entitled Method of Producing Stackable Concrete Blocks.

A Serpentine Wall

Figure 19A:
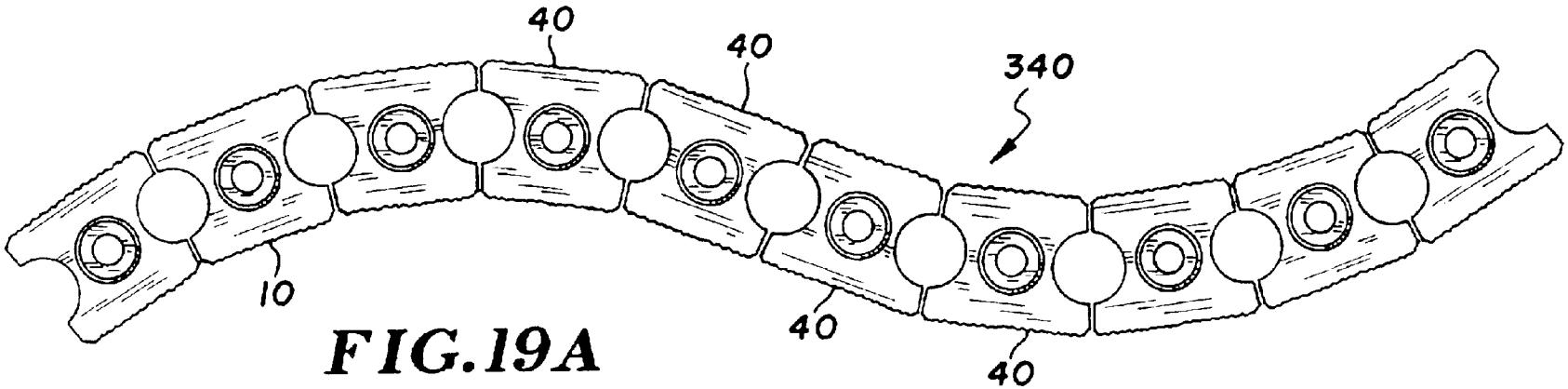
FIG. 19A is a top view of a portion of a serpentine wall having a relatively great amount of stability.

A serpentine or undulating wall can be formed by 1) curved wall combinations, 2) straight wall combinations and/or 3) curved and straight wall combinations. For example, FIG. 19A shows a serpentine wall portion 340 formed by curved wall portions shown in FIG. 16A. The serpentine wall portion 310 uses ten angle blocks 10 for one full "wavelength," but as few as four angle blocks 10 can be used for one full "wavelength" for a serpentine wall portion 340. A second "wavelength" of ten angle blocks 10 may be placed in interlocking fashion on top of the undulating row 340 shown in FIG. 19A, with the second "wavelength" of ten angle blocks being offset from the undulating row 340 by a distance of one-half the length of one angle block 10 such that the secondary core portions of the second "wavelength" are seated in the interlocks 54 of the first "wavelength."

Figure 19B:
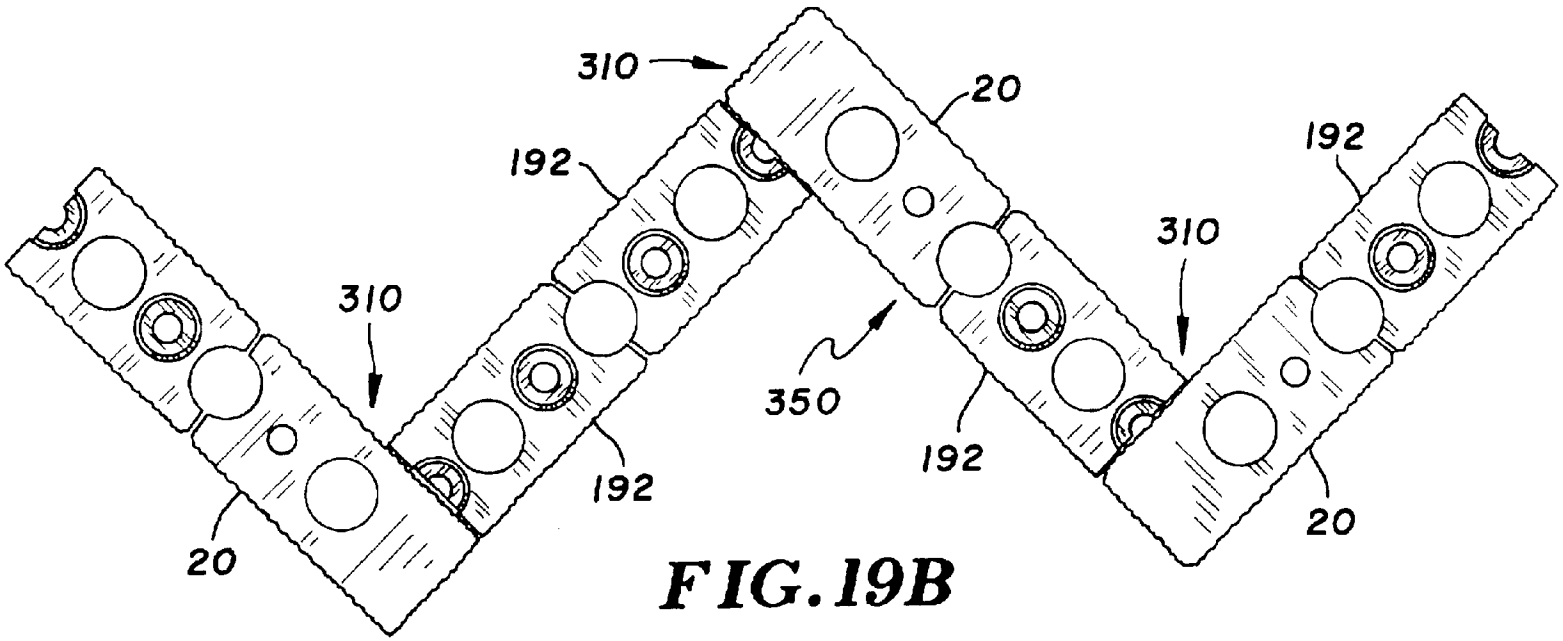
FIG. 19B is a top view of a portion of another type of serpentine or zig zag like wall having a great amount of stability.

Another type of serpentine wall is shown in FIG. 19B where a zig-zag type of serpentine wall portion 350 includes a number of corners, such as corner 310 as shown in FIG. 17A. Here a second "wavelength" may be placed on top of the wall portion 350 with the corner blocks 20 being staggered as shown in FIG. 17A for each of the corners 310 such that the field modified block 192 interlocks the corners 310 to each other.

Blocks of the present invention, other than that shown in FIGS. 19A and 19B, may be used to form serpentine walls or zig-zag like walls.

With all other factors being equal, a serpentine wall has a relatively great amount of stability when compared to a straight wall. For example, whereas a straight wall may be considered to have stability merely along the longitudinal length of the wall, a serpentine wall has stability both in the longitudinal and lateral directions.

Stability of the Wall

Stability of a wall formed by one or more blocks of the present invention is provided by one or more of the following features: 1) the interlocking and seating features of the blocks; 2) the mass of the blocks used in the wall; 3) the flatness of the upper and lower faces of the blocks; 4) the shape of the wall, especially where serpentine or zig-zag or "step function" like walls are built; and 5) piping, as described above, running downwardly in the cores and driven into the ground.

Stability of the Wall—Interlocking of the Blocks

As to the interlocking and seating features, the interlocks (54, 92, 94, 96, 142, 144, 182, 184, 186) of lower blocks can be seated in the relatively large cores (122, 214) and in the secondary cores formed by the secondary core portions (46, 50, 134, 138, 230) of the upper blocks. It should be noted that the relatively small cores (42, 126, 128, 218) cannot provide seats for the interlocks since these relatively small cores are of a lesser size (lesser radius or diameter) than the outside diameter or radius of the interlocks. Cores 42, 126, 128 and 218 are interlock-excluding cores. Cores 122, 214 are interlock-receiving or interlock-seating cores. The secondary cores are interlock-receiving or interlock-seating cores, such as via their size or such as via their shape. The interlocks cannot fit into the such relatively small cores 42, 126, 128 and 218 and thereby provide a warning to one constructing a wall that he or she has not found a proper interlocking fit. In other words, the only proper fit between adjoining blocks of different height is a self-aligning interlocking fit.

In still other words, if, upon laying one of the blocks upon a lower row of blocks, the lower face of the just laid down block is flat against the upper face of the lower row, then one can be assured that he or she has an interlocking fit. In yet other words, adjoining blocks of different height do not interlock if one attempts to seat an interlock core upon an interlock.

Stability of the Wall—Mass or Density of the Block

As to the mass or weight of the blocks, the density of a block is preferably between about 120 pounds per cubic foot and about 140 pounds per cubic foot, more preferably between about 125 and about 140 pounds per cubic foot, and most preferably between about 130 pounds per cubic foot and about 140 pounds per cubic foot. The weight of a block is preferably sufficiently small to permit the block to be managed by a homeowner (e.g., to be lifted into place about three or four feet from the ground by an adult woman or adult man of average strength). The weight of the block is preferably as great as possible to lend as much stability to the wall as possible.

Stability of the Wall—Flatness of the Load Bearing Faces

Without taking into account the interlocks or interlocking segments, the upper faces (30, 110, 202) and lower faces (32, 112, 204) of the blocks (10, 12, 14, 16, 18, 20) are preferably as flat as possible. In other words, the upper and lower faces are preferably free of recesses or extensions except for the interlocks, cores and secondary core portions. In still other words, not taking into account the interlocks, cores, or secondary core portions, the upper and lower faces are preferably 90% free of such nonflat features, more preferably 95% free of such nonflat features, and yet more preferably 99% free of such nonflat features, and most preferably 99.9% or more free of such nonflat features. In considering flatness, the standard rough surface of a cement block and the usual nicks in a surface of such cement block are not taken into account. Given the standard rough surface and the usual nicks, the upper and lower faces are substantially flat with no recesses, no grooves, no scores, no extensions, no nubs, no ribs, or any other feature deviating from a flat surface. Such flatness provides a downward load or force that is equalized or spread out over the entire wall, thereby providing for relatively great stability. Flatness further means that "all points of the upper surface shall be contained between two parallel planes, the base plane and the roof plane, separated by a distance no greater than that specified and that all points of the lower surface shall be contained between two parallel planes, the base plane and the roof plane, separated by a distance no greater than that specified." Such a specified distance is preferably less than about one-quarter of an inch, more preferably less than about one-eighth of an inch, yet more preferably less than about one-sixteenth of an inch, and most preferably less than about one-thirty seconds of an inch. Flatness further means that the upper surface lies in a plane that is parallel to a plane in which the lower surface lies.

Such blocks where flatness is maximized also provide for maximizing friction in the lateral and longitudinal directions. This minimizes the chance that during construction of a wall, a block is knocked or slid off a wall, whereupon the block break upon hitting the ground.

Composition of Blocks

Each of the blocks 10, 12, 14, 16, 18, 20, 22, 24 may be formed by almost any variety of a concrete mixture or fill. The mixture or fill may depend upon a number of factors, including the desired strength of the block, the desired water absorption, the desired density, the desired shrinkage and other physical characteristics. A cementations mixture for such blocks may include one or more of cement, fly ash, water, sand, gravel, rock, plasticizers, water proofing agents, crosslinking agents, dyes, colorants, and pigments.

Exposed Surfaces of the Blocks

The exposed surfaces of the blocks of the present invention, such as where the exposed surfaces are the sides 38, 40 of angle blocks 10, 12, or the sides 118, 120 of stretcher blocks 14, 16, 18, or the sides 210, 212 and end 206 of corner block 20, are preferably finished. A finished surface may be textured or nontextured. A finished surface may be antiqued or nonantiqued. A finished surface that is textured is preferred. A finished surface that is textured by using the mold layouts of the present invention, such as the mold layouts of FIGS. 4, 8, or 10, is more preferred.

Construction of walls according to the present invention provides the opportunity to have both vertical surfaces of the wall finished based on the form and fit of the individual units or blocks. This feature develops the basis for a structure that is functional and that is architecturally appealing.

What is claimed is:

1. A building block, comprising:

a) first and second load bearing faces, wherein the first and second load bearing faces are disposed opposite of each other, wherein the first and second load bearing faces are disposed generally parallel to each other, wherein the first and second load bearing faces are substantially flat;

b) first and second ends, wherein the first and second ends are disposed opposite of each other, wherein each of the first and second ends is transverse to each of the first and second load bearing faces;

c) first and second sides, wherein the first and second sides are disposed opposite each other, wherein the first and second sides are disposed generally parallel to each other, wherein each of the first and second sides is transverse to each of the first and second load bearing faces and each of the first and second, ends;

d) a first inner core formed in the building block and extending to and between the load bearing faces, wherein the first inner core is spaced from each of the first and second ends, and wherein the first inner core is spaced from each of the first and second sides;

e) an end core portion formed in each of the first and second ends, with the end core portion extending to and between the load bearing faces; and f) an interlock protruding from one of the load bearing faces and forming at least a portion of a periphery of the first inner core, wherein the interlock and end core portion are shaped such that an interlock of one building block can confront a surface forming an end core portion of another confronting building block, wherein the end core portion is not vertically aligned with a protruding interlock on the same building block, and wherein each of the first inner core, interlock and end core portion has an arcuate shape;

g) such that, upon staggering building blocks with each other at first and second levels, an interlock of a building block at the first level can be received in an end core portion of a building block at the second level.

2. The building block of claim 1, wherein each of the sides is textured.

3. The building black of claim 1, wherein the interlock comprises first and second segments spaced from each other to define a space for splitting the building block.

4. The building block of claim 1, wherein each of the first and second load bearing faces that are substantially flat are 99% free of nonflat features, excluding said interlock, first inner core, and end core portion.

5. The building block of claim 1, wherein all points of the first load bearing face, excluding the interlock, first inner core, and end core portion, are contained by two parallel planes, a base plane and a roof plane, that are separated by a specified distance, and wherein all points of the second load bearing face are contained by two parallel planes, a base plane and a roof plane, that are separated by a specified distance, and wherein the specified distance is less than about one eighth of an inch.

6. A building block, comprising:

a) first and second load bearing faces, wherein the first and second load bearing faces are disposed opposite of each other, wherein the first and second load bearing faces are disposed generally parallel to each other, wherein the first and second load bearing faces are substantially flat;

b) first and second ends, wherein the first and second ends are disposed opposite of each other, wherein each of the first and second ends is transverse to each of the first and second load bearing faces;

c) first and second sides, wherein the first and second sides are disposed opposite each other, wherein the first and second sides are disposed generally parallel to each other, wherein each of the first and second sides is transverse to each of the first and second load bearing faces and each of the first and second, ends;

d) a first inner core formed in the building block and extending to and between the load bearing faces, wherein the first inner core is spaced from each of the first and second ends, and wherein the first inner core is spaced from each of the first and second sides;

e) a second inner core formed in the building block and extending to and between the load bearing faces, wherein the second inner core is spaced from each of the first and second ends, wherein the second inner core is spaced from each of the first and second sides, wherein the second inner core is spaced from the first inner core;

f) an end core portion formed in each of the first and second ends, with the end core portion extending to and between the load bearing faces; and g) an interlock protruding from one of the load bearing faces and forming at least a portion of a periphery of the first inner core, h) a size for the interlock that is sufficiently great such that the interlock is excluded from being received in the first inner core; and i) a size for the interlock that is sufficiently small such that the interlock can be received in the second inner core.

j) wherein the interlock and end core portion are shaped such that an interlock of one building block can confront a surface forming an end core portion of another confronting building block and wherein each of the first inner core, interlock and end core portion has an arcuate shape;

k) such that, upon staggering building blocks with each other at first and second levels, an interlock of a building block at the first level can be received in an end core portion of a building block at the second level.

7. A building block, comprising:

a) first and second load bearing faces, wherein the first and second load bearing faces are disposed opposite of each other, wherein the first and second load bearing faces are disposed generally parallel to each other, wherein the first and second load bearing faces are substantially flat;

b) first and second ends, wherein the first and second ends are disposed opposite of each other, wherein each of the first and second ends is transverse to each of the first and second load bearing faces;

c) first and second sides, wherein the first and second sides are disposed opposite each other, wherein the first and second sides are disposed generally parallel to each other, wherein each of the first and second sides is transverse to each of the first and second load bearing faces and each of the first and second, ends;

d) a first inner core formed in the building block and extending to and between the load bearing faces, wherein the first inner core is spaced from each of the first and second ends, and wherein the first inner core is spaced from each of the first and second sides;

e) a second inner core formed in the building block and extending to and between the load bearing faces, wherein the second inner core is spaced from each of the first and second ends, wherein the second inner core is spaced from each of the first and second sides, wherein the second inner core is spaced from the first inner core;

f) an end core portion formed in each of the first and second ends, with the end core portion extending to and between the load bearing faces; and g) an interlock protruding from one of the load bearing faces and forming at least a portion of a periphery of the first inner core, h) a shape for the interlock that excludes the interlock from being received in the first inner core; and i) a shape for the interlock that permits the interlock to be received in the second inner core j) wherein the interlock and end core portion are shaped such that an interlock of one building block can confront a surface forming an end core portion of another confronting building block and wherein each of the first inner core, interlock and end core portion has an arcuate shape;

k) such that, upon staggering building blocks with each other at first and second levels, an interlock of a building block at the first level can be received in an end core portion of a building block at the second level.

8. A building block, comprising:

a) first and second load bearing faces, wherein the first and second load bearing faces are disposed opposite of each other, wherein the first and second load bearing faces are disposed generally parallel to each other, wherein the first and second load bearing faces are substantially flat;

b) first and second ends, wherein the first and second ends are disposed opposite of each other, wherein each of the first and second ends is transverse to each of the first and second load bearing faces;

c) first and second sides, wherein the first and second sides are disposed opposite each other, wherein the first and second sides are disposed generally parallel to each other, wherein each of the first and second sides is transverse to each of the first and second load bearing faces and each of the first and second, ends;

d) a first inner core formed in the building block and extending to and between the load bearing faces, wherein the first inner core is spaced from each of the first and second ends, and wherein the first inner core is spaced from each of the first and second sides;

e) an end core portion formed in each of the first and second ends, with the end core portion extending to and between the load bearing faces; and f) an interlock protruding from one of the load bearing faces and forming at least a portion of a periphery of the first inner core, wherein the interlock and end core portion are shaped such that an interlock of one building block can confront a surface forming an end core portion of another confronting building block and wherein each of the first inner core, interlock and end core portion has an arcuate shape;

g) such that, upon staggering building blocks with each other at first and second levels, an interlock of a building block at the first level can be received in an end core portion of a building block at the second level h) wherein the building block is formed from a mold, wherein each of the sides of the building block has been split from other masonry such that each of the sides of the building block has a textured face.

9. The building block of any one of claims 1, 6, 7, or 8, wherein the arcuate shape is generally circular.

10. A building block, comprising:

a) first and second load bearing faces, wherein the first and second load bearing fares are disposed opposite of each other, wherein the first and second load bearing faces are disposed generally parallel to each other, wherein the first and second load bearing faces are substantially flat;

b) first and second ends, wherein the first and second ends are disposed opposite of each other, wherein each of the first and second ends is transverse to each of the first and second load bearing faces;

c) first and second sides, wherein the first and second sides are disposed opposite each other, wherein the first and second sides are disposed generally parallel to each other, wherein each of the first and second sides is transverse to each of the first and second load bearing faces and each of the first and second, ends, wherein each of the ends includes a face, and wherein the faces are oblique relative to the sides of the block;

d) a first inner core formed in the building block and extending to and between the load bearing faces, wherein the first inner core is spaced from each of the first and second ends, and wherein the first inner core is spaced from each of the first and second sides;

e) an end core portion formed in each of the first and second ends, with the end core portion extending to and between the load bearing faces; and f) an interlock protruding from one of the load bearing faces and forming at least a portion of a periphery of the first inner core, wherein the interlock and end core portion are shaped such that an interlock of one building block can confront a surface forming an end core portion of another confronting building block;

g) such that, upon staggering building blocks with each other at first and second levels, an interlock of a building block at the first level can be received in an end core portion of a building block at the second level.

11. A building block, comprising:

a) first and second load bearing faces, wherein the first and second load bearing faces are disposed opposite of each other, wherein the first and second load bearing faces are disposed generally parallel to each other, wherein the first and second load bearing faces are substantially flat;

b) first and second ends, wherein the first and second ends are disposed opposite of each other, wherein each of the first and second ends is transverse to each of the first and second load bearing faces;

c) first and second sides, wherein the first and second sides are disposed opposite each other, wherein the first and second sides are disposed generally parallel to each other, wherein each of the first and second sides is transverse to each of the first and second load bearing faces and each of the first and second, ends, wherein each of the ends includes a face, and wherein the faces are oblique relative to the sides of the block and parallel to each other;

d) a first inner core formed in the building block and extending to and between the load bearing faces, wherein the first inner core is spaced from each of the first and second ends, and wherein the first inner core is spaced from each of the first and second sides;

e) an end core portion formed in each of the first and second ends, with the end core portion extending to and between the load bearing faces; and f) an interlock protruding from one of the load bearing faces and forming at least a portion of a periphery of the first inner core, wherein the interlock and end core portion are shaped such that an interlock of one building block can confront a surface forming an end core portion of another confronting building block;

g) such that, upon staggering building blocks with each other at first and second levels, an interlock of a building block at the first level can be received in an end core portion of a building block at the second level.

12. A building block, comprising:

a) first and second load bearing faces, wherein the first and second load bearing faces are disposed opposite of each other, wherein the first and second load bearing faces are disposed generally parallel to each other, wherein the first and second load bearing faces are substantially flat;

b) first and second ends, wherein the first and second ends are disposed opposite of each other, wherein each of the first and second ends is transverse to each of the first and second load bearing faces;

c) first and second sides, wherein the first and second sides are disposed opposite each other, wherein the first and second sides are disposed generally parallel to each other, wherein each of the first and second sides is transverse to each of the first and second load bearing faces and each of the first and second, ends, wherein each of the ends includes a face, and wherein the faces are oblique relative to the sides of the block and inclining toward each other;

d) a first inner core formed in the building block and extending to and between the load bearing faces, wherein the first inner core is spaced from each of the first and second ends, and wherein the first inner core is spaced from each of the first and second sides;

e) an end core portion formed in each of the first and second ends, with the end core portion extending to and between the load bearing faces; and f) an interlock protruding from one of the load bearing faces and forming at least a portion of a periphery of the first inner core, wherein the interlock and end core portion are shaped such that an interlock of one building block can confront a surface forming an end core portion of another confronting building block;

g) such that, upon staggering building blocks with each other at first and second levels, an interlock of a building block at the first level can be received in an end core portion of a building block at the second level.

13. A building block, comprising:

a) first and second load bearing faces, wherein the first and second load bearing faces are disposed opposite of each other, wherein the first and second load bearing faces are disposed generally parallel to each other, wherein the first and second load bearing faces are substantially flat;

b) first and second ends, wherein the first and second ends are disposed opposite of each other, wherein each of the first and second ends is transverse to each of the first and second load bearing faces;

c) first and second sides, wherein the first and second sides are disposed opposite each other, wherein the first and second sides are disposed generally parallel to each other, wherein each of the first and second sides is transverse to each of the first and second load bearing faces and each of the first and second ends;

d) a pair of first inner cores formed in the building block, wherein each of the first inner cores extend to and between the load bearing faces, wherein each of the first inner cores is spaced from each of the first and second ends, wherein each of the first inner core is spaced from each of the first and second sides, wherein each of the inner cores is spaced from each other, and wherein each of the inner cores includes a radius;

e) a second inner core formed in the building block and extending to and between the load bearing faces, wherein the second inner core is spaced from each of the first and second ends, wherein the second inner core is spaced from each of the first and second sides, wherein the second inner core is spaced from and intermediate each of the first inner cores, and wherein the second inner core includes a radius;

f) an end core portion formed in each of the first and second ends, with the end core portion extending to and between the load bearing sides, with the end core portion having a radius; and g) an interlock about each of the first inner cores and protruding from one of the load bearing faces, wherein each of the interlocks has an outer radius that is greater than the radius of the first inner cores such that the interlocks are excluded from first inner cores of other building blocks, wherein each of the interlocks has an outer radius that is less than the radius of the end core portions and second inner core such that the interlocks can be seated in end core portions and second inner cores of other building blocks, wherein each of the interlocks and end core portion are shaped such that one of the interlocks of one building block can confront a surface forming an end core portion of another confronting building block and such that the other of the interlocks of said building block can confront a surface forming said second inner core;

h) such that, upon staggering building blocks with each other at first and second levels, one of the interlocks of a building block at the first level can be received in an end core portion of a building block at the second level and the other interlock of said building block can be received in the second inner core of said building block at said second level at the same time.

14. The building block of claim 13, wherein each of the sides is textured.

15. The building block of claim 13, wherein the building block is formed from a mold, wherein each of the sides of the building block has been split from other masonry such that each of the sides of the building block has a textured face.

16. The building block of claim 13, wherein each of the ends includes a face, and wherein the faces are oblique relative to the sides of the block.

17. The building block of claim 13, wherein each of the ends includes a face, and wherein the faces are oblique relative to the sides of the block and parallel to each other.

18. The building block of claim 13, wherein each of the ends includes a face, and wherein the faces are oblique relative to the sides of the block and inclining toward each other.

19. The building block of claim 13, wherein one of the interlocks comprises first and second segments spaced from each other to define a space for splitting the building block.

20. The building block of claim 13, wherein the second inner core is defined by a wall that includes a recess for serving as an aid for splitting the building block.

21. The building block of claim 13, wherein each of the first and second load bearing faces that are substantially flat are 99% free of nonflat features, excluding said interlock, first inner cores, second inner core, and end core portion.

22. The building block of claim 13, wherein all points of the first load bearing face, excluding the interlock, first inner cores, second inner core, and end core portion, are contained by two parallel planes, a base plane and a roof plane, that are separated by a specified distance, and wherein all points of the second load bearing face are contained by two parallel planes, a base plane and a roof plane, that are separated by a specified distance, and wherein the specified distance is less than about one-eighth of an inch.

23. A building block, comprising:

a) first and second load bearing faces, wherein the first and second load bearing faces are disposed opposite of each other, wherein the first and second load bearing faces are disposed generally parallel to each other, wherein the first and second load bearing faces are substantially flat;

b) first and second ends, wherein the first and second ends are disposed opposite of each other, wherein each of the first and second ends is transverse to each of the first and second load bearing faces, wherein one of the ends is generally normal to each of the first and second sides, and wherein the other of the ends includes a pair of flat surfaces that are oblique to each of the first and second sides;

c) first and second sides, wherein the first and second sides are disposed opposite each other, wherein the first and second sides are disposed generally parallel to each other, wherein each of the first and second sides is transverse to each of the first and second load bearing faces and each of the first and second ends;

d) a first inner core formed in the building block, wherein the inner core extends to and between the load bearing faces, wherein the inner core is spaced from each of the first and second ends, wherein the inner core is spaced from each of the first and second sides, and wherein the inner core includes a radius;

e) a second inner core formed in the building block and extending to and between the load bearing faces, wherein the second inner core is spaced from each of the first and second ends, wherein the second inner core is spaced from each of the first and second sides, wherein the second inner core is spaced from the first inner core, and wherein the second inner core includes a radius;

f) an end core portion formed in said end having said pair of flat surfaces, wherein the end core portion is intermediate the flat surfaces, wherein the end core portion extends to and between the load bearing sides, and wherein the end core portion includes a radius;

g) wherein the radius of the first inner core is less than the radius of the second inner core and is less than the radius of the end core portion;

h) wherein the radius of the second inner core is about the radius of the end core portion; and i) wherein the first inner core is intermediate the second inner core and the end core portion.

24. A set of building blocks useful in forming a wall having two or more courses of blocks positioned end-to-end in each course, each block having upper and lower parallel load bearing surfaces, first and second ends, and first and second opposed faces, the ends being transverse to the load bearing surfaces and the opposed faces, the load bearing surfaces of the blocks having mating interlocks comprising arcuate cores and protruding arcuate interlocks receivable in the cores, wherein the interlocking cores are not vertically aligned with the protruding interlocks on the same building block, the blocks being configured so that each end of a block comprises a half interlock and adjacent ends of a pair of blocks in a course together define an interlock portion that interlocks with a mating full interlock portion carried by a block in an adjacent course of blocks.

25. The set of building blocks of claim 24, each block being formed with an inner core extending between the load bearing surfaces and spaced from the ends and faces of the block.

26. The set of building blocks of claim 25, further comprising a splitter wedge proximate to the inner core.

27. The set of building blocks of claim 24, wherein the full interlock protrudes upwardly from the first load bearing surface.

28. The set of building blocks of claim 27, wherein each block is formed with an inner core extending between the load bearing surfaces and spaced from the ends and faces of the block and the full interlock is aligned with the inner core.

29. The set of building blocks of claim 28, wherein the full interlock comprises an annular boss disposed around the inner core.

30. The set of building blocks of claim 29, wherein the annular boss is discontinuous.

31. The set of building blocks of claim 24, wherein the half interlocks comprise external end core portions extending between the load bearing surfaces, the end core portions of adjacent blocks in a course together forming a core configured to receive an interlock of a block in an adjacent course.

32. The set of building blocks of claim 31, configured so that when the building block is placed end-to-end with another building block the end faces cooperate to form an opening between the building blocks extending from the first load bearing surface to the second load bearing surface.

33. The set of building blocks of claim 24, wherein the full interlock comprises a hole or depression in the first load bearing surface.

34. The set of building blocks of claim 33, wherein the half interlock protrudes upwardly from the first load bearing surface.

35. The set of building blocks of claim 34, wherein each block is formed with an end core portion and the half interlock comprises a semicircular boss disposed around the end core portion.

36. The set of building blocks of claim 24, wherein the load bearing surfaces are shaped generally as a parallelogram.

37. The set of building blocks of claim 36, further comprising a second full interlock in the load bearing surface.

38. The set of building blocks of claim 37, further comprising a third full interlock in the load bearing surface.

39. The set of building blocks of claim 36, wherein the building block has a second core through the building block from the first load bearing surface to the second load bearing surface.

40. The set of building blocks of claim 39, wherein the building block has a third core through the building block from the first load bearing surface to the second load bearing surface.

41. The set of building blocks of claim 24, wherein the blocks of the set are oriented to form a wall of at least two courses of blocks, wherein one course of blocks is stacked upon another course, at least one course having blocks juxtaposed end-to-end so that their half interlocks together form an interlock that engages the full interlock of a block in an adjacent course.

42. The set of building blocks of claim 41, wherein the wall is generally straight when viewed from above.

43. The set of building blocks of claim 41, wherein the wall contains one or more corners when viewed from above.

44. The set of building blocks of claim 24, wherein the arcuate shape is generally circular.

45. A set of building blocks useful in forming a wall having two or more courses of blocks positioned end-to-end in each course, each block having upper and lower parallel load bearing surfaces shaped generally as trapezoids, first and second ends, and first and second opposed faces, the ends being transverse to the load bearing surfaces and the opposed faces, the load bearing surfaces of the blocks having mating interlocks comprising cores and protruding interlocks receivable in the cores, wherein the interlocking cores are not vertically aligned with the protruding interlocks on the same building block, the blocks being configured so that each end of a block comprises a half interlock and adjacent ends of a pair of blocks in a course together define an interlock that interlocks with a mating full interlock carried by a block in an adjacent course of blocks.

46. The set of building blocks of any one of claims 24 or 40, wherein the side faces are finished in an aesthetically pleasing manner.

47. The set of building blocks of any one of claims 24 or 40, wherein both ends of the block have a half interlock.

48. The set of building blocks of any one of claims 24 or 45, wherein the block further comprises a splitter wedge to enable easier splitting of the building block.

49. The set of building blocks of any one of claims 24 or 45, further comprising a corner block, the corner block comprising a first and second parallel load bearing surfaces, first and second ends, and first and second side faces, and each block including a full interlock disposed on the first load bearing surface, wherein the first end of the corner block has a half interlock and the second end of the corner block is a finished end face.

50. The set of building blocks of claim 45, wherein the full interlock protrudes upwardly from the first load bearing surface.

51. The set of building blocks of claim 50, wherein each block is formed with an inner core extending between the load bearing surfaces and spaced from the ends and faces of the block and the full interlock is aligned with the inner core.

52. The set of building blocks of claim 51, wherein the full interlock comprises an annular boss disposed around the inner core.

53. The set of building blocks of claim 52, wherein the annular boss is discontinuous.

54. The set of building blocks of claim 45, wherein the half interlocks comprise external end core portions extending between the load bearing surfaces, the end core portions of adjacent blocks in a course together forming a core configured to receive an interlock of a block in an adjacent course.

55. The set of building blocks of claim 54, configured so that when a building block is placed end-to-end with another building block the end faces cooperate to form an opening between the building blocks extending from the first load bearing surface to the second load bearing surface.

56. The set of building blocks of claim 45, each block being formed with an inner core extending between the load bearing surfaces and spaced from the ends and faces of the block.

57. The set of building blocks of claim 56, further comprising a splitter wedge proximate to the inner core.

58. The set of building blocks of claim 45, wherein the full interlock comprises a hole or depression in the first load bearing surface.

59. The set of building blocks of claim 58, wherein the half interlock protrudes upwardly from the first load bearing surface.

60. The set of building blocks of claim 59, wherein each block is formed with an end core portion and the half interlock comprises a semicircular boss disposed around the end core portion.

61. The set of building blocks of claim 45, wherein the blocks of the set are oriented to form a wall of at least two courses of blocks, wherein one course of blocks is stacked upon another course, at least one course having blocks juxtaposed end-to-end so that their half interlocks together form an interlock that engages the full interlock of a block in an adjacent course.

62. The set of building blocks of claim 61, wherein the wall is generally straight when viewed from above.

63. The set of building blocks of claim 61, wherein the wall contains one or more corners when viewed from above.

64. The set of building blocks of claim 45, wherein the interlocking cores and protruding interlocks have an arcuate shape.

65. The set of building blocks of claim 64, wherein the arcuate shape is generally circular.

66. A set of building blocks useful in forming a wall having two or more courses of blocks positioned end-to-end in each course, each block having upper and lower parallel load bearing surfaces, first and second ends, and first and second opposed faces, the ends being transverse to the load bearing surfaces and the opposed faces, the load bearing surfaces of the blocks having mating interlocks comprising cores and protruding interlocks receivable in the cores, wherein the interlocking cores are not vertically aligned with the protruding interlocks on the same building block, the blocks being configured so that each end of a block comprises a half interlock and adjacent ends of a pair of blocks in a course together define an interlock that interlocks with a mating full interlock carried by a block in an adjacent course of blocks; wherein the blocks of the set are oriented to form a wall of at least two courses of blocks, wherein one course of blocks is stacked upon another course, at least one course having blocks juxtaposed end-to-end so that their half interlocks together form an interlock that engages the full interlock of a block in an adjacent course and wherein the wall contains one or more curved sections when viewed from above.

* * * * *